US008321210B2

(12) United States Patent
Grill et al.

(10) Patent No.: US 8,321,210 B2
(45) Date of Patent: Nov. 27, 2012

(54) AUDIO ENCODING/DECODING SCHEME HAVING A SWITCHABLE BYPASS

(75) Inventors: Bernhard Grill, Lauf (DE); Stefan Bayer, Nuremberg (DE); Guillaume Fuchs, Erlangen (DE); Stefan Geyersberger, Wuerzburg (DE); Ralf Geiger, Erlangen (DE); Johannes Hilpert, Nuremberg (DE); Ulrich Kraemer, Stuttgart (DE); Jeremie Lecomte, Fürth (DE); Markus Multrus, Nuremberg (DE); Max Neuendorf, Nuremberg (DE); Harald Popp, Tuchenbach (DE); Nikolaus Rettelbach, Nuremberg (DE); Roch Lefebvre, Canton de Magog (CA); Bruno Bessette, Sherbrooke (CA); Jimmy Lapierre, Orford (CA); Philippe Gournay, Sherbrooke (CA); Redwan Salami, St-Laurent (CA)

(73) Assignees: Fraunhofer-Gesellschaft zur Foerderung der Angewandten Forschung E.V., Munich (DE); Voiceage Corporation, Montreal, Quebec (CA)

( * ) Notice: Subject to any disclaimer, the term of this patent is extended or adjusted under 35 U.S.C. 154(b) by 30 days.

(21) Appl. No.: 13/007,412

(22) Filed: Jan. 14, 2011

(65) Prior Publication Data

US 2011/0202355 A1 Aug. 18, 2011

Related U.S. Application Data

(63) Continuation of application No. PCT/EP2009/004875, filed on Jul. 6, 2009.

(60) Provisional application No. 61/081,586, filed on Jul. 17, 2008.

(30) Foreign Application Priority Data

Feb. 18, 2009 (EP) ..... 09002270

(51) Int. Cl.
*G10L 19/14* (2006.01)
*G10L 21/00* (2006.01)
*G10L 19/00* (2006.01)

(52) U.S. Cl. ..... 704/205; 704/201; 704/211; 704/500

(58) Field of Classification Search ..... 704/500–504
See application file for complete search history.

(56) References Cited

U.S. PATENT DOCUMENTS 7,516,064 B2 * 4/2009 Vinton et al. ..... 704/206
7,979,271 B2 * 7/2011 Bessette ..... 704/219

(Continued)

FOREIGN PATENT DOCUMENTS

WO WO 2008/071353 6/2008

OTHER PUBLICATIONS

ISO/IEC JTC1/SC29/WG11/MPEG2007/N9519, Call for Proposals on Unified Speech and Audio Coding.

(Continued)

*Primary Examiner* — Samuel G Neway
(74) *Attorney, Agent, or Firm* — Michael A. Glenn; Glenn Patent Group

(57) ABSTRACT

An apparatus for encoding includes a first domain converter, a switchable bypass, a second domain converter, a first processor and a second processor to obtain an encoded audio signal having different signal portions represented by coded data in different domains, which have been coded by different coding algorithms. Corresponding decoding stages in the decoder together with a bypass for bypassing a domain converter allow the generation of a decoded audio signal with high quality and low bit rate.

20 Claims, 21 Drawing Sheets

U.S. PATENT DOCUMENTS

| | | | | |
|---|---|---|---|---|
| 2002/0156637 | A1* | 10/2002 | Azuma et al. | 704/275 |
| 2003/0004711 | A1* | 1/2003 | Koishida et al. | 704/223 |
| 2006/0173675 | A1* | 8/2006 | Ojanpera | 704/203 |
| 2010/0138218 | A1* | 6/2010 | Geiger | 704/205 |

OTHER PUBLICATIONS

ISO/IEC 14496-3, Information technology: Coding of audio-visual objects, Part 3: Audio.

ISO/IEC 23003-1, MPEG Surround.

Sean A. Ramprashad: "The Multimode Transform Predictive Coding Paradigm" IEEE Transactions on Speech and Audio Processing, IEEE Service Center, New York, US, vol. 11, No. 2, Mar. 1, 2003.

TSG-SA WG4: 3GPP TS 26.290 version 2.0.0 Extended Adaptive Multi-Rate—Wideband codec; Transcoding functions (Release 6) 3GPP Draft, XP050202966.

* cited by examiner (Encoder)

(Decoder)

(Encoder)

(Decoder)

• each block of the first domain audio signal is represented by either a first domain, or a second domain, a third domain or a fourth domain encoded signal, apart from a optional crossover region Analysis-by-synthesis CELP $A_L(z)$: Long Term Prediction
≙pitch (fine) structure A(z): Short Term Prediction
≙ form and structure / special envelope (encoder side)

(decoder side)

AUDIO ENCODING/DECODING SCHEME HAVING A SWITCHABLE BYPASS

CROSS-REFERENCE TO RELATED APPLICATIONS

This application is a continuation of copending International Patent Application No. PCT/EP2009/004875, which was filed on Jul. 6, 2009, which is incorporated herein by reference in its entirety, and additionally claims priority from U.S. Patent Application No. 61/081,586 filed Jul. 17, 2008 and also claims priority to European Patent Application No. 09002270.8 filed on Feb. 18, 2009, both of which are also incorporated herein in their entirety by reference.

BACKGROUND OF THE INVENTION

The present invention is related to audio coding and, particularly, to low bit rate audio coding schemes.

In the art, frequency domain coding schemes such as MP3 or AAC are known. These frequency-domain encoders are based on a time-domain/frequency-domain conversion, a subsequent quantization stage, in which the quantization error is controlled using information from a psychoacoustic module, and an encoding stage, in which the quantized spectral coefficients and corresponding side information are entropy-encoded using code tables.

On the other hand there are encoders that are very well suited to speech processing such as the AMR-WB+ as described in 3GPP TS 26.290. Such speech coding schemes perform a Linear Predictive filtering of a time-domain signal. Such a LP filtering is derived from a Linear Prediction analyze of the input time-domain signal. The resulting LP filter coefficients are then coded and transmitted as side information. The process is known as Linear Prediction Coding (LPC). At the output of the filter, the prediction residual signal or prediction error signal which is also known as the excitation signal is encoded using the analysis-by-synthesis stages of the ACELP encoder or, alternatively, is encoded using a transform encoder, which uses a Fourier transform with an overlap. The decision between the ACELP coding and the Transform Coded excitation coding which is also called TCX coding is done using a closed loop or an open loop algorithm.

Frequency-domain audio coding schemes such as the high efficiency-AAC encoding scheme, which combines an AAC coding scheme and a spectral bandwidth replication technique can also be combined to a joint stereo or a multichannel coding tool which is known under the term "MPEG surround".

On the other hand, speech encoders such as the AMR-WB+ also have a high frequency enhancement stage and a stereo functionality.

Frequency-domain coding schemes are advantageous in that they show a high quality at low bitrates for music signals. Problematic, however, is the quality of speech signals at low bitrates.

Speech coding schemes show a high quality for speech signals even at low bitrates, but show a poor quality for music signals at low bitrates.

SUMMARY

According to an embodiment, an apparatus for encoding an audio signal to acquire an encoded audio signal, the audio signal being in a first domain, may have: a first domain converter for converting the audio signal from the first domain into a second domain; a switchable bypass for bypassing the first domain converter or for causing a conversion of the audio signal by the first domain converter in response to a bypass switch control signal; a second domain converter for converting an audio signal received from the switchable bypass or the first domain converter into a third domain, the third domain being different from the second domain; a first processor for encoding the third domain audio signal in accordance with a first coding algorithm; and a second processor for encoding the audio signal received from the first domain converter in accordance with a second coding algorithm being different from the first coding algorithm to acquire a second processed signal, wherein the encoded signal for a portion of the audio signal either includes the first processed signal or the second processed signal.

According to another embodiment, a method of encoding an audio signal to acquire an encoded audio signal, the audio signal being in a first domain, may have the steps of: converting the audio signal from the first domain into a second domain; bypassing converting the audio signal from the first domain into a second domain or causing a conversion of the audio signal from the first domain into a second domain in response to a bypass switch control signal; converting a bypassed audio signal or an audio signal in the second domain into a third domain, the third domain being different from the second domain; encoding the third domain audio signal generated by converting the bypassed audio signal or the audio signal in the second domain in accordance with a first coding algorithm; and encoding the audio signal in the second domain in accordance with a second coding algorithm being different from the first coding algorithm to acquire a second processed signal, wherein the encoded signal for a portion of the audio signal either includes the first processed signal or the second processed signal.

According to another embodiment, an apparatus for decoding an encoded audio signal, the encoded audio signal including a first processed signal being in a third domain and a second processed signal being in a second domain, wherein the second domain and the third domain are different from each other, may have: a first inverse processor for inverse processing the first processed signal; a second inverse processor for inverse processing the second processed signal; a second converter for domain converting the first inverse processed signal from the third domain into a different domain; a first converter for converting the second inverse processed signal into a first domain or for converting the first inverse processed signal, which was converted into a different domain, into the first domain when the different domain is not the first domain; and a bypass for bypassing the first converter when the different domain is the first domain.

According to another embodiment, a method of decoding an encoded audio signal, the encoded audio signal including a first processed signal being in a third domain and a second processed signal being in a second domain, wherein the second domain and the third domain are different from each other, may have the steps of: inverse processing the first processed signal; inverse processing the second processed signal; second domain converting the first inverse processed signal from the third domain into a different domain; first domain converting the second inverse processed signal into a first domain or converting the first inverse processed signal into the first domain when the different domain is not the first domain; and bypassing first domain converting when the different domain is the first domain.

Another embodiment may have a computer program for performing, when running on a computer, a method of encoding an audio signal to acquire an encoded audio signal, the audio signal being in a first domain, which method may have the steps of: converting the audio signal from the first domain into a second domain; bypassing converting the audio signal from the first domain into a second domain or causing a conversion of the audio signal from the first domain into a second domain in response to a bypass switch control signal; converting a bypassed audio signal or an audio signal in the second domain into a third domain, the third domain being different from the second domain; encoding the third domain audio signal generated by converting the bypassed audio signal or the audio signal in the second domain in accordance with a first coding algorithm; and encoding the audio signal in the second domain in accordance with a second coding algorithm being different from the first coding algorithm to acquire a second processed signal, wherein the encoded signal for a portion of the audio signal either includes the first processed signal or the second processed signal.

Another embodiment may have a computer program for performing, when running on a computer, a method of decoding an encoded audio signal, the encoded audio signal including a first processed signal being in a third domain and a second processed signal being in a second domain, wherein the second domain and the third domain are different from each other, which method may have the steps of: inverse processing the first processed signal; inverse processing the second processed signal; second domain converting the first inverse processed signal from the third domain into a different domain; first domain converting the second inverse processed signal into a first domain or converting the first inverse processed signal into the first domain when the different domain is not the first domain; and bypassing first domain converting when the different domain is the first domain.

In an encoder in accordance with the present invention, two domain converters are used, wherein the first domain converter converts an audio signal from the first domain such as the time domain into a second domain such as an LPC domain. The second domain converter is operative to convert from an input domain into an output domain and the second domain converter receives, as an input, an output signal of the first domain converter or an output signal of a switchable bypass, which is connected to bypass the first domain converter. In other words, this means that the second domain converter receives, as an input, the audio signal in the first domain such as the time domain or, alternatively, the output signal of the first domain converter, i.e. an audio signal, which has already been converted from one domain to a different domain. The output of the second domain converter is processed by a first processor in order to generate a first processed signal and the output of the first domain converter is processed by a second processor in order to generate a second processed signal. Advantageously, the switchable bypass can additionally be connected to the second processor as well so that the input into the second processor is the time domain audio signal rather than an output of the first domain converter.

This extremely flexible coding concept is specifically useful for high quality and high bit-efficient audio coding, since it allows to encode an audio signal in at least three different domains and, when the switchable bypass is additionally connected to the second processor as well, even in four domains. This can be achieved by controllable switching the switchable bypass in order to bypass or bridge the first domain converter for a certain portion of the time domain audio signal or not. Even if the first domain converter is bypassed, two different possibilities for encoding the time domain audio signal still remain, i.e. via the first processor connected to a second domain converter or the second processor.

Advantageously, the first processor and the second domain converter together form an information-sink model coder such as the pyschoacoustically-driven audio encoder as known from MPEG 1 Layer 3 or MPEG 4 (AAC).

Advantageously, the other encoder, i.e., the second processor is a time domain encoder, which is, for example, the residual encoder as known from an ACELP encoder, where the LPC residual signal is encoded using a residual coder such as a vector quantization coder for the LPC residual signal or a time domain signal. In an embodiment, this time domain encoder receives, as an input, an LPC domain signal, when the bypass is open. Such a coder is an information source model encoder since, in contrast to the information sink model coder, the information source model coder is specifically designed to utilize specifics of a speech generation model. When, however, the bypass is closed, the input signal into the second processor will be a time domain signal rather than an LPC domain signal.

If, however, the switchable bypass is deactivated, which means that the audio signal from the first domain is converted into a second domain before being further processed, two different possibilities again remain, i.e. to either code the output of the first domain converter in the second domain, which can, for example, be an LPC domain or to alternatively transform the second domain signal into a third domain, which can, for example, be a spectral domain.

Advantageously, the spectral domain converter, i.e. the second domain converter, is adapted to implement the same algorithm irrespective as to whether the input signal into the second domain converter is in the first domain such as the time domain or is in the second domain such as the LPC domain.

On the decoder side, two different decoding branches exists where one decoding branch includes a domain converter, i.e. the second domain converter, while the other decoding branch only includes an inverse processor, but does not include a domain converter. Depending on the actual bypass setting on the encoder side, i.e. whether the bypass was active or not, a first converter in a decoder is bypassed or not. In particular, the first converter in a decoder is bypassed when the output of the second converter is already in the target domain such as the first or time domain. If, however, the output of the second converter in the decoder is in a domain different from the first domain, then the decoder bypass is deactivated and the signal is converted from the different domain into the target domain, i.e. the first domain in the advantageous embodiment. The second processed signal is, in one embodiment, in the same domain, i.e. in the second domain, but in other embodiments in which a switchable bypass on the encoder side is also connectable to the second processor, the output of the second inverse processor on the decoder side can already be in the first domain as well. In this case, the first converter is bypassed using the switchable bypass on the decoder side so that a decoder output combiner receives input signals, which represent different portions of an audio signal and which are in the same domain. These signals can be time-multiplexed by the combiner or can be cross-faded by the decoder output combiner.

In an advantageous embodiment, the apparatus for encoding comprises a common pre-processing stage for compressing an input signal. This common pre-processing stage may include the multi-channel processor and/or a spectral bandwidth replication processor so that the output of the common pre-processing stage for all different coding modes is a compressed version with respect to an input into the common pre-processing stage. Correspondingly, the output signal of the decoder side combiner can be post-processed by a common post-processing stage which, for example, is operative to perform a spectral bandwidth replication synthesis and/or a multi-channel expanding operation such as a multi-channel upmix operation, which is advantageously guided using parametric multi-channel information transmitted from the encoder side to the decoder side.

In an advantageous embodiment, the first domain in which the audio signal input into the encoder and the audio signal output by the decoder is located, is the time domain. In an advantageous embodiment, the second domain in which the output of the first domain converter is positioned, is an LPC domain so that the first domain converter is an LPC analysis stage. In a further embodiment, the third domain, i.e. in which the output of the second domain converter is positioned, is a spectral domain or is a spectral domain of the LPC domain signal generated by the first domain converter. The first processor connected to the second domain converter is advantageously implemented as an information sink coder such as a quantizer/scaler together with an entropy reducing code such as a pyschoacoustically driven quantizer connected to an Huffman encoder or an arithmetic encoder, which performs the same functionalities, irrespective as to whether the input signal is in the spectral domain or the LPC spectral domain.

In a further advantageous embodiment, the second processor for processing the output of the first domain converter or for processing the output of the switchable bypass in a full functionality device is a time domain encoder such as a residual signal encoder used in the ACELP encoder or in any other CELP encoders.

BRIEF DESCRIPTION OF THE DRAWINGS

Embodiments of the present invention will be detailed subsequently referring to the appended drawings, in which.

DETAILED DESCRIPTION OF THE INVENTION

Figure 1A:
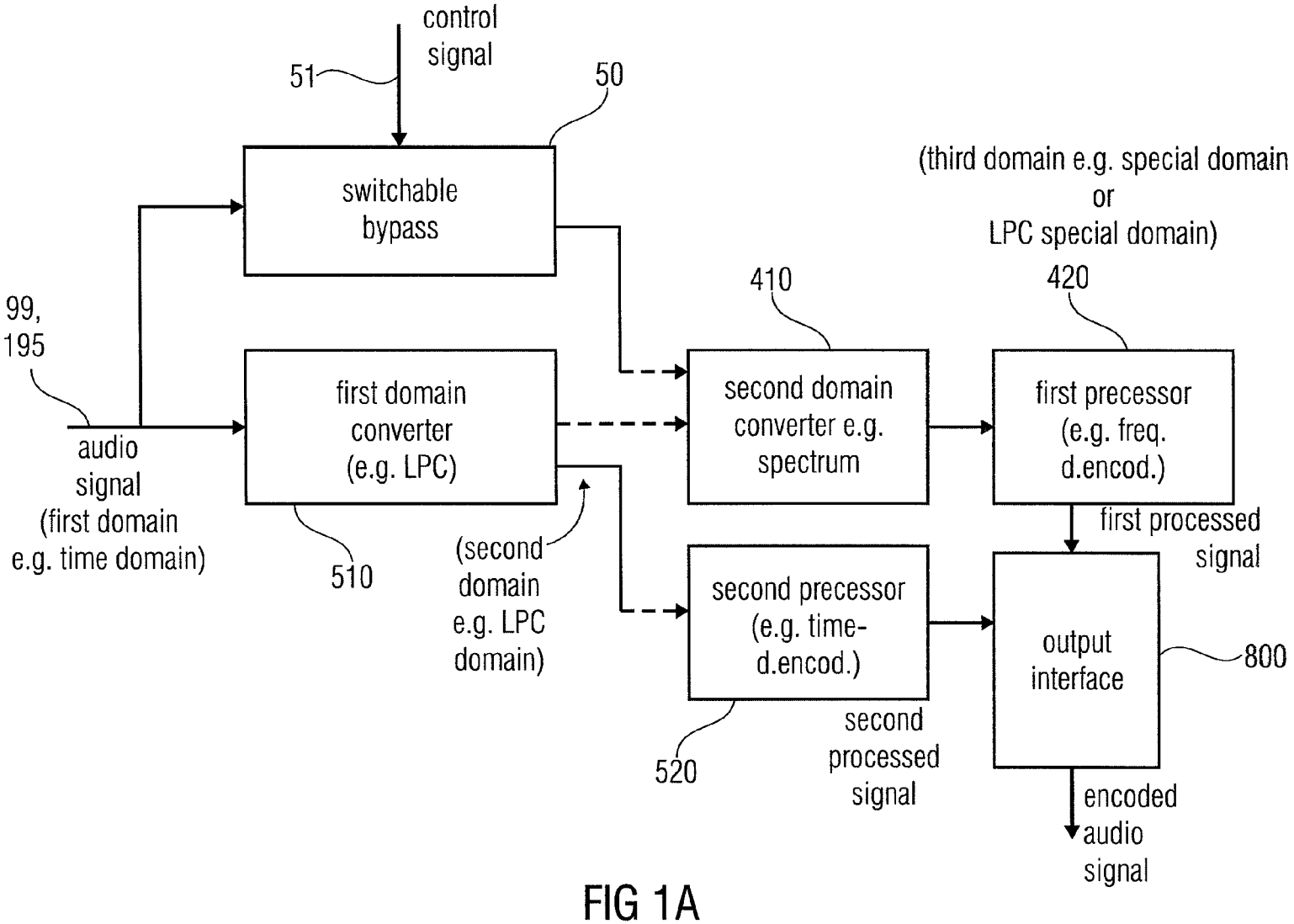
FIG. 1*a* is a block diagram of an encoding scheme in accordance with a first aspect of the present invention.

FIG. 1*a* illustrates an embodiment of the invention in which there are two domain converters 510, 410 and the switchable bypass 50. The switchable bypass 50 is adapted to be active or inactive in reply to a control signal 51, which is input into a switching control input of the switchable bypass 50. If the switchable bypass is active, the audio signal at an audio signal input 99, 195 is not fed into the first domain converter 510, but is fed into the switchable bypass 50 so that the second domain converter 410 receives the audio signal at the input 99, 195 directly. In one embodiment, which will be discussed in connection with FIGS. 1*c* and 1*d*, the switchable bypass 50 is alternatively connectable to the second processor 520 without being connected to the second domain converter 410 so that the switchable bypass 50 output signal is processed via the second processor 520 only.

If, however, the switchable bypass 50 is set in an inactive state by the control signal 51, the audio signal at the audio signal input 99 or 195 is input into the first domain converter 510 and is, at the output of the first domain converter 510, either input into the second domain converter 410 or the second processor 520. The decision as to whether the first domain converter output signal is input into the second domain converter 410 or the second processor 520 is advantageously taken, based on a switch control signal as well, but can, alternatively, be done via other means such as metadata or based on a signal analysis. Alternatively, the first domain converter signal 510 can even be input into both devices 410, 520 and the selection, which process signal is input into the output interface to represent the audio signal in a certain time portion, is done via a switch connected between the processors and the output interface as discussed in connection with FIG. 4*b*. On the other hand, the decision as to which signal is input into the output data stream can also be taken within the output interface 800 itself.

As illustrated in FIG. 1*a*, the inventive apparatus for encoding an audio signal to obtain an encoded audio signal where the audio signal at input 99/195 is in the first domain comprises the first domain converter for converting the audio signal from the first domain into a second domain. Furthermore, the switchable bypass 54 bypassing the first domain converter 510 or for causing a conversion of the audio signal by the first domain converter in response to a bypass switch control signal 51 is provided. Thus, in the active state, the switchable bypass bypasses the first domain converter and, in the non-active state, the audio signal is input into the first domain converter.

Furthermore, the second domain converter 410 for converting the audio signal received from the switchable bypass 50 or the first domain converter into a third domain is provided. The third domain is different from the second domain. In addition, a first processor 420 for encoding the third domain audio signal in accordance with a first coding algorithm to obtain a first processed signal is provided. Furthermore, a second processor 520 for encoding the audio signal received from the first domain converter in accordance with a second coding algorithm is provided where the second coding algorithm is different from the first coding algorithm. The second processor provides the second processed signal. In particular, the apparatus is adapted to have an encoded audio signal at the output thereof for a portion of the audio signal where this encoded signal either includes the first processed signal or the second processed signal. Naturally, there can be cross-over regions, but in view of an enhanced coding efficiency, the target is to keep the cross-over regions as small as possible and to eliminate them wherever possible so that a maximum bit-rate compression is obtained.

Figure 1B:
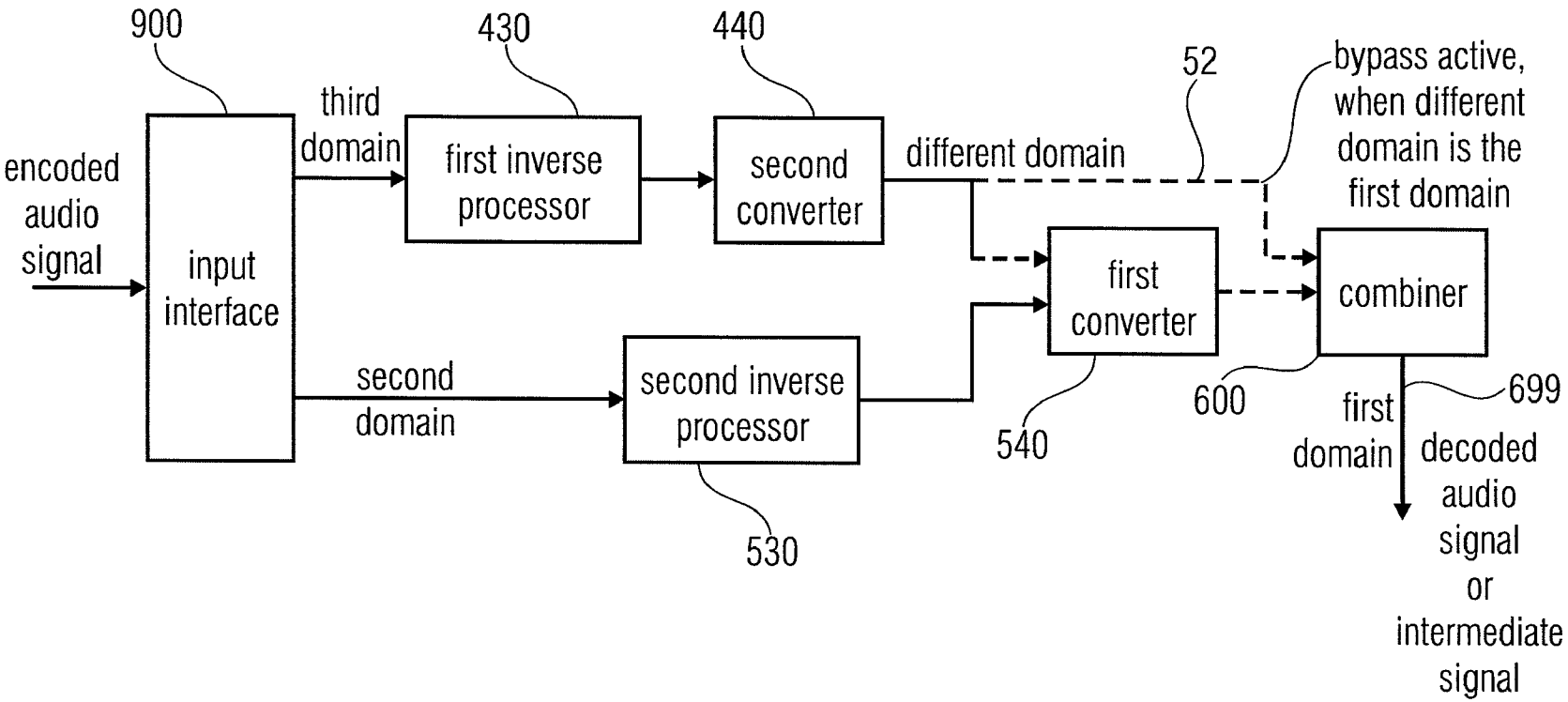
FIG. 1*b* is a block diagram of a decoding scheme in accordance with the first aspect of the present invention.

FIG. 1*b* illustrates a decoder corresponding to the encoder in FIG. 1*a* in an advantageous embodiment. The apparatus for decoding an encoded audio signal in FIG. 1*b* receives, as an input, an encoded audio signal comprising a first processed signal being in a third domain and a second processed signal being in a second domain, where the second domain and the third domain are different from each other. In particular, the signal input into an input interface 900 is similar to the output from the interface 800 of FIG. 1*a*. The apparatus for decoding comprises a first inverse processor 430 for inverse processing the first processed signal and a second inverse processor 530 for inverse processing the second processed signal. Additionally, a second converter 440 for domain converting the first inverse processed signal from the third domain into a different domain is provided. In addition, a first converter 540 for converting the second inverse processed signal into a first domain or for converting the first inverse processed signal into the first domain when the different domain is not the first domain is provided. This means that the first inverse processed signal is only converted by the first converter when the first processed signal is not already in the first domain, i.e. in a target domain in which the decoded audio signal or the intermediate audio signal in case of a pre-processing/post-processing circuit is to be. Furthermore, the decoder comprises a bypass 52 for bypassing the first converter 540 when the different domain is the first domain. The circuit in FIG. 1*b* furthermore comprises a combiner 600 for combining an output of the first converter 540 and a bypass output, i.e. a signal output by the bypass 52 to obtain a combined decoded audio signal 699, which can be used as it is or which can even be decompressed using a common post-processing stage, as will be discussed later on.

Figure 1C:
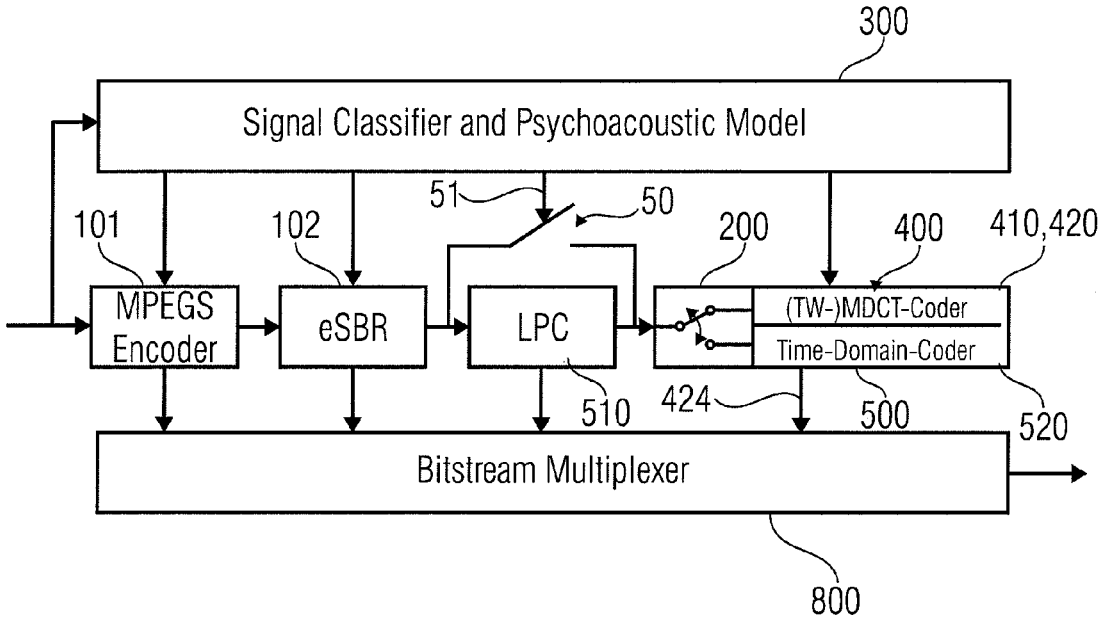
FIG. 1*c* is a block diagram of an encoding scheme in accordance with a further aspect of the present invention.

FIG. 1*c* illustrates an advantageous embodiment of the inventive audio encoder in which the signal classifier in pyschoacoustic model 300 is provided for classifying the audio signal input into a common pre-processing stage formed by an MPEG Surround encoder 101 and an enhanced spectral band replication processor 102. Furthermore, the first domain converter 510 is an LPC analysis stage and the switchable bypass is connected between an input and an output of the LPC analysis stage 510, which is the first domain converter.

Figure 7A:
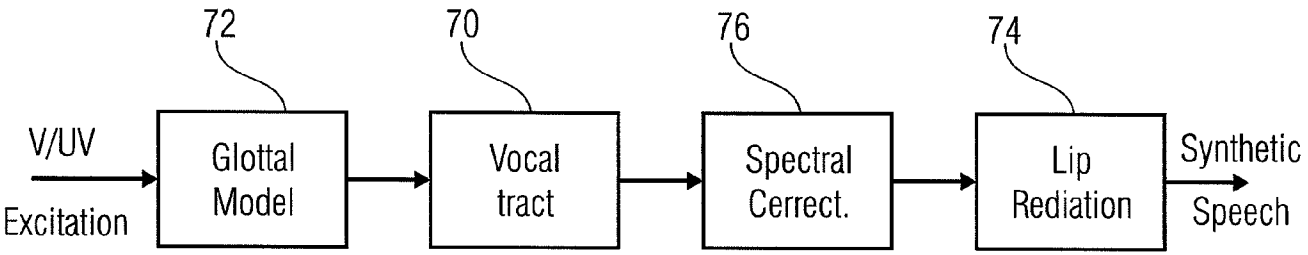
FIGS. 7*a* to 7*d* illustrate voiced/unvoiced excitation signals as an example for impulse-like and stationary signals.
Figure 7B:
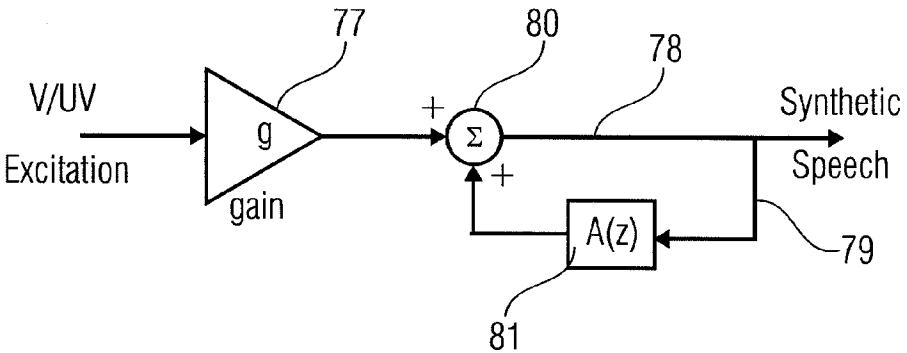
Figure 7C:
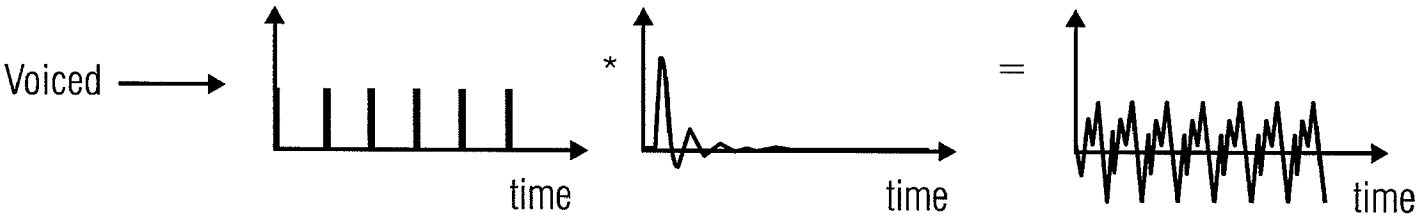
Figure 7D:
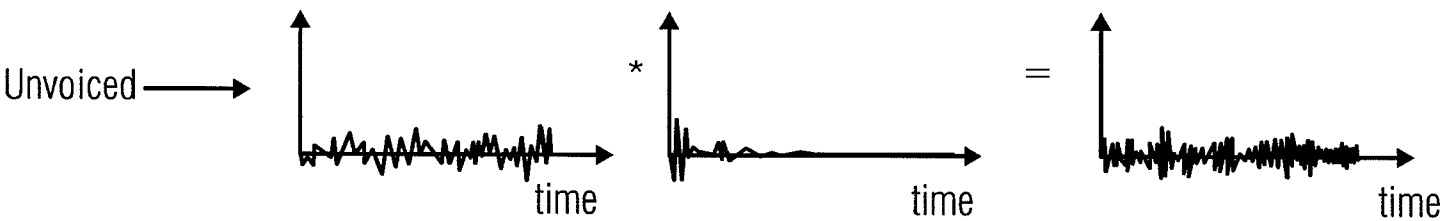
Figure 7E:
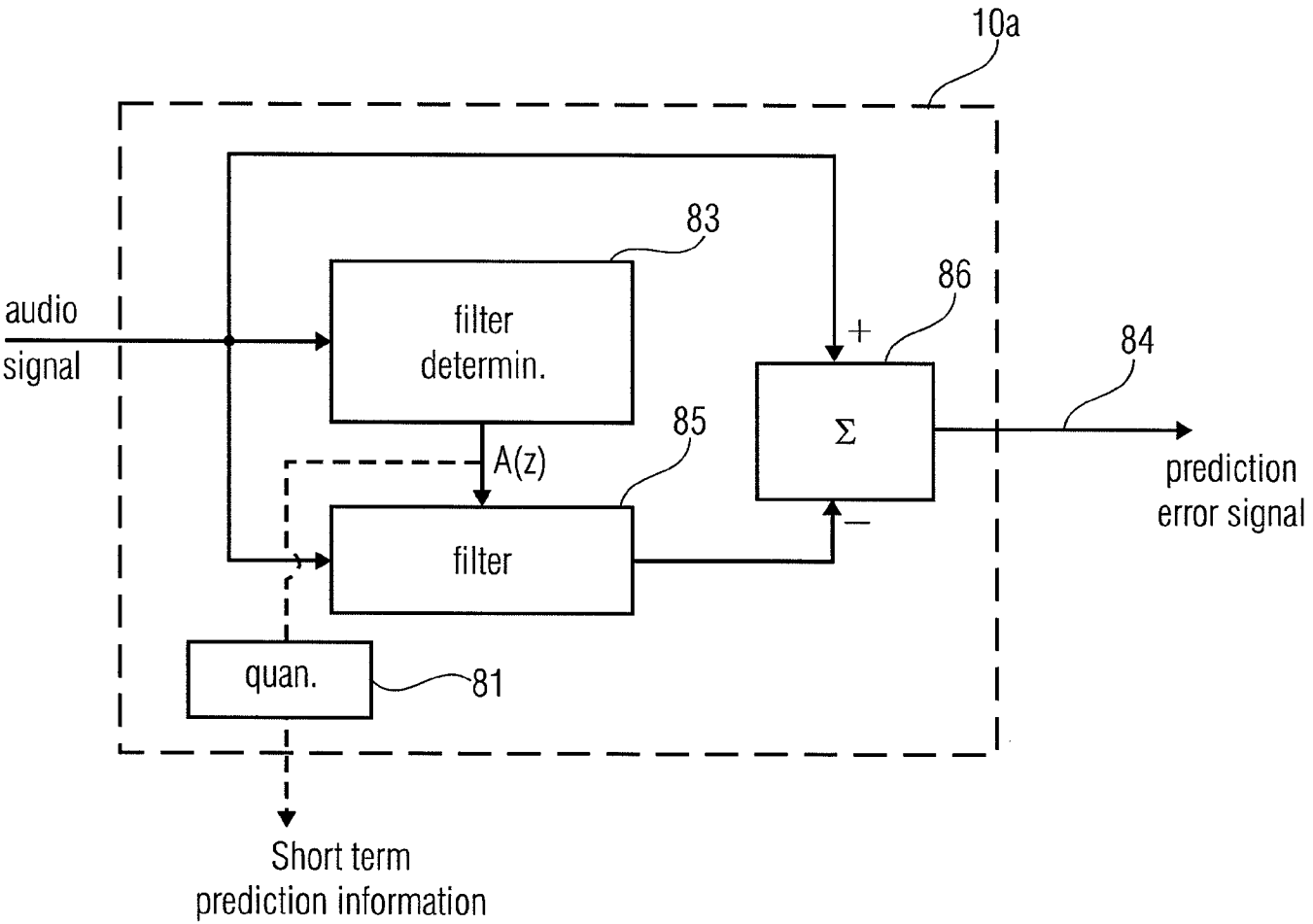
FIG. 7*e* illustrates an encoder-side LPC stage providing short-term prediction information and the prediction error signal.
Figure 7F:
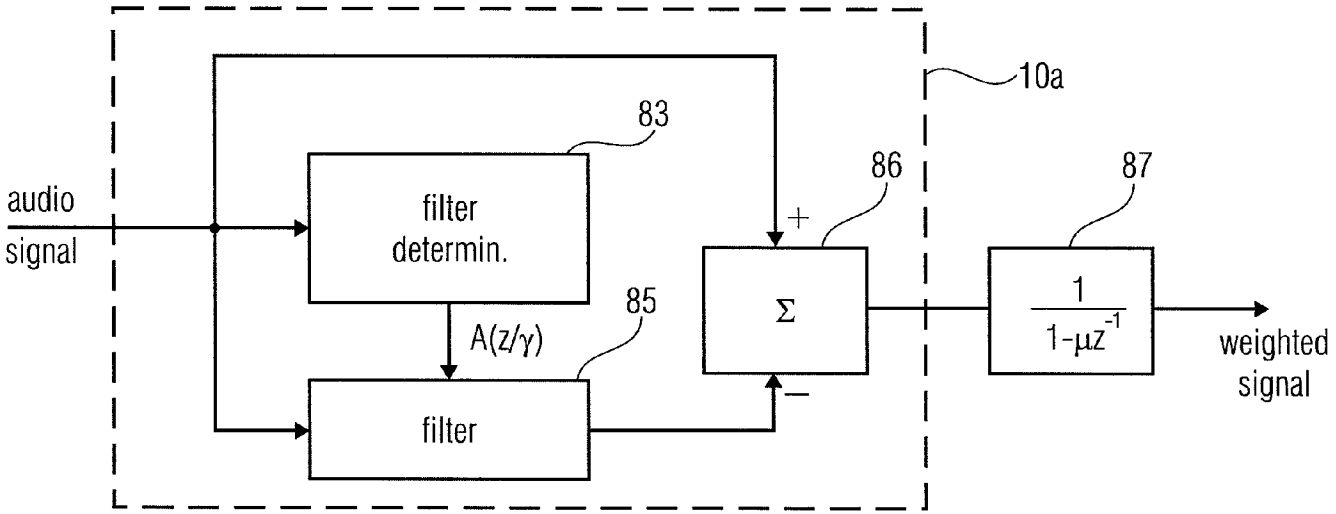
FIG. 7*f* illustrates a further embodiment of an LPC device for generating a weighted signal.

The LPC device generally outputs an LPC domain signal, which can be any signal in the LPC domain such as the excitation signal in FIG. 7*e* or a weighted signal in FIG. 7*f* or any other signal, which has been generated by applying LPC filter coefficients to an audio signal. Furthermore, an LPC device can also determine these coefficients and can also quantize/encode these coefficients.

Additionally, a switch 200 is provided at the output of the first domain converter so that a signal at the common output of the bypass 50 and the LPC stage 510 is forwarded either to a first coding branch 400 or a second coding branch 500. The first coding branch 400 comprises the second domain converter 410 and the first processor 420 from FIG. 1*a* and the second coding branch 500 comprises the second processor 520 from FIG. 1*a*. In the FIG. 1*c* encoder embodiment, the input of the first domain converter 510 is connected to the input of the switchable bypass 50 and the output of the switchable bypass 50 is connected to the output of the first domain converter 510 to form a common output and this common output is the input into the switch 200 where the switch comprises two outputs, but can even comprise additional outputs for additional encoding processors.

Advantageously, the second domain converter 410 in the first coding branch 400 comprises an MDCT transform, which, additionally, is combined with a switchable time-warp (TW) functionality. The MDCT spectrum is encoded using a scalar/quantizer, which performs a quantization of input values based on information provided from the pyschoacoustic model located within the signal classifier block 300. On the other hand, the second processor comprises a time domain encoder for time domain encoding the input signal. In one embodiment, the switch 200 is controlled so that in case of an active/closed bypass 50, the switch 200 is automatically set to the upper coding branch 400. In a further embodiment, however, the switch 200 can also be controlled independent of the switchable bypass 50 even when the bypass is active/closed so that the time domain coder 520 can directly receive the time domain audio input signal.

Figure 1D:
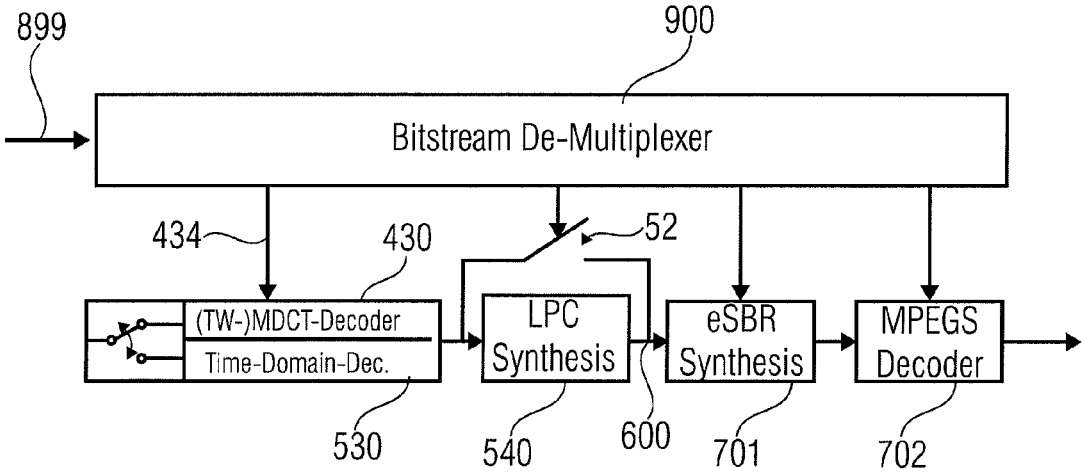
FIG. 1*d* is a block diagram of a decoding scheme in accordance with the further aspect of the present invention.

FIG. 1*d* illustrates a corresponding decoder where the LPC synthesis block 540 corresponds to the first converter of FIG. 1*b* and can be bypassed via the bypass 52, which is advantageously a switchable bypass controlled via a bypass signal generated by the bit stream de-multiplexer 900. The bit stream de-multiplexer 900 may generate this signal and all other control signals for the coding branches 430, 530 or the SBR synthesis block 701 or the MPEG Surround decoder block 702 from an input bit stream 899 or may receive the data for these control lines from a signal analysis or any other separate information source.

Subsequently, a more detailed description of the embodiment in FIG. 1*c* for the encoder and FIG. 1*d* for the decoder will be given.

The advantageous embodiment consists of a hybrid audio coder, which combines the strengths of successful MPEG technology, such as AAC, SBR and MPEG Surround with successful speech-coder technology. The resulting codec comprises a common pre-processing for all signal categories, consisting of MPEG Surround and an enhanced SBR (eSBR). Controlled by a pyschoacoustic model and based on the signal category, an information sink or source derived coder architecture is selected on a frame-per-frame basis.

The proposed codec advantageously uses coding tools, like MPEG Surround, SBR and the AAC base coder. These have received alterations and enhancements to improve the performance for speech and at very low bitrates. At higher bitrates the performance of AAC is at least matched, as the new codec can fall back to a mode very close to AAC. An enhanced noiseless coding mode is implemented, which provides on average a slightly better noiseless coding performance. For bitrates of approx. 32 kbps and below additional tools are activated to improve the performance of the base coder for speech and other signals. The main components of these tools are an LPC based frequency shaping, more alternative window length options for the MDCT based coder and a time domain coder. A new bandwidth extension technique is used as an extension to the SBR tool, which is better suited to low crossover frequencies and for speech. The MPEG Surround tool provides a parametric representation of a stereo or multichannel signal by providing a down mix and parameterized stereo image. For the given test cases, it is used to encode stereo signals only, but is also suited for multi-channel input signals by making use of the existing MPEG Surround functionality from MPEG-D.

All tools in the codec chain with the exception of the MDCT-Coder are advantageously used at low bit rates only.

MPEG Surround technology is used to transmit N audio input channels via M audio transmission channels. Thus, the system is inherently multi-channel capable. The MPEG Surround technology has received enhancements to increase the performance at low bitrates and for speech like signals.

Basic operation mode is the creation of a high quality mono down mix from the stereo input signal. Additionally, a set of spatial parameters is extracted. On the decoder-side, a stereo output signal is generated using the decoded mono down mix in combination with the extracted and transmitted spatial parameters. A low bit rate 2-1-2 mode has been added to the existing 5-x-5 or 7-x-7 operating points in MPEG Surround, using a simple tree structure that consists of a single OTT (one-to-two) box in the MPEG Surround upmix. Some of the components have received modifications to better adapt to the speech reproduction. For higher data rates, such as 64 kbps and above, the core code is using discrete stereo coding (Mid/Side or L/R), MPEG Surround is not used for this operation point.

The bandwidth extension proposed in this technology submission is based on MPEG SBR technology. The filter bank used is identical to the QMF filterbank in MPEG Surround and SBR, offering the possibility to share QMF domain samples between MPEG Surround and SBR without additional synthesis/analysis. Compared to the standardized SBR tool, eSBR introduces an enhanced processing algorithm, which is optimal for both, speech and audio content. An extension to SBR is included, which is better suited for very low bitrates and low cross-over frequencies.

As known from the combination of SBR and AAC, this feature can be de-activated globally, leaving coding of the whole frequency range to the core coder.

The core coder part of the proposed system can be seen as the combination of an optional LPC filter and a switchable frequency domain/time domain core coder.

As known from speech coder architectures, the LPC filter provides the basis for a source model for human speech. The LPC processing can be en- or disabled (bypassed) globally or on a frame-by-frame basis.

Following the LPC filter, the LPC domain signal is encoded using either a time domain or transform based frequency domain coder architecture. Switching between these two branches is controlled by an extended pyschoacoustic model.

The time domain coder architecture is based on the ACELP technology, providing optimal coding performance especially for speech signals at low bitrates.

The frequency domain based codec branch is based on an MDCT architecture with scalar quantizer and entropy coding.

Optionally, a time-warping tool is available to enhance the coding efficiency for speech signals at higher bitrates (such as 64 kbps and above) through a more compact signal representation.

The MDCT based architecture delivers good quality at lower bitrates and scales towards transparency as known from existing MPEG technologies. It can converge to an AAC mode at higher bitrates.

Buffer requirements are identical to AAC, i.e. the maximum number of bits in the input buffer is 6144 per core-coder channel: 6144 bits per mono channel element, 12288 bits per stereo channel-pair element.

A bit reservoir is controlled at the encoder, which allows adaptation of the encoding process to the current bit demand. Characteristics of the bit reservoir are identical to AAC.

The encoder and decoder are controllable to operate on different bitrates between 12 kbps mono and 64 kpbs stereo.

The decoder complexity is specified in terms of PCU. For the base decoder a complexity of approx. 11.7 PCU may be used. In case the time-warping tool is used, as for the 64 kbps test mode, the decoder complexity is increased to 22.2 PCU.

The requirements for RAM and ROM for an advantageous stereo decoder are:

| | |
|---|---|
| RAM: | ~24 kWords |
| ROM: | ~150 kWords |

By notifying the entropy coder, an overall ROM size of only ~98 kWords can be obtained.

In case the time-warping tool is used, RAM demand is increased by ~3 kWords, ROM demand is increased by ~40 kWords.

Theoretical algorithmic delay is dependent on the tools used in the codec chain (e.g. MPEG Surround etc.): The algorithmic delay of the proposed technology is displayed per operating point at the codec sampling rate. The values given below do not include a framing delay, i.e. the delay needed to fill the encoder input buffer with the number of samples needed to process the first frame. This framing delay is 2048 samples for all specified operating modes. The subsequent tables contain both, the minimum algorithmic delay and the delay for the implementation used. Additional delay to resample 48 kHz input PCM files to the codec sampling rate is specified in '(.)'.

| Test ID | Theoretical minimum algorithmic delay (samples) | Algorithmic delay as implemented (samples) |
|---|---|---|
| Test 1, 64 kbps stereo | 8278 | 8278 (+44) |
| Test 2, 32 kbps stereo | 9153 | 11201 (+44) |

-continued

| Test ID | Theoretical minimum algorithmic delay (samples) | Algorithmic delay as implemented (samples) |
|---|---|---|
| Test 3, 24 kbps stereo | 9153 | 11200 (+45) |
| Test 4, 20 kbps stereo | 9153 | 9153 (+44) |
| Test 5, 16 kbps stereo | 11201 | 11201 (+44) |
| Test 6, 24 kbps mono | 4794 | 5021 (+45) |
| Test 7, 20 kbps mono | 4794 | 4854 (+44) |
| Test 8, 16 kbps mono | 6842 | 6842 (+44) |
| Test 9, 12 kbps mono | 6842 | 6842 (+44) |

The main attributes of this codec can be summarized as follows:

The proposed technology advantageously uses state-of-the-art speech and audio coding technology, without sacrificing performance for coding either speech or music content. This results in a codec which is capable of delivering state-of-the-art quality for speech-, music- and mixed content for a bitrate range starting at very low rates (12 kbps) and going up to high data rates such as 128 kbps and above, at which the codec reaches transparent quality.

Figure 2A:
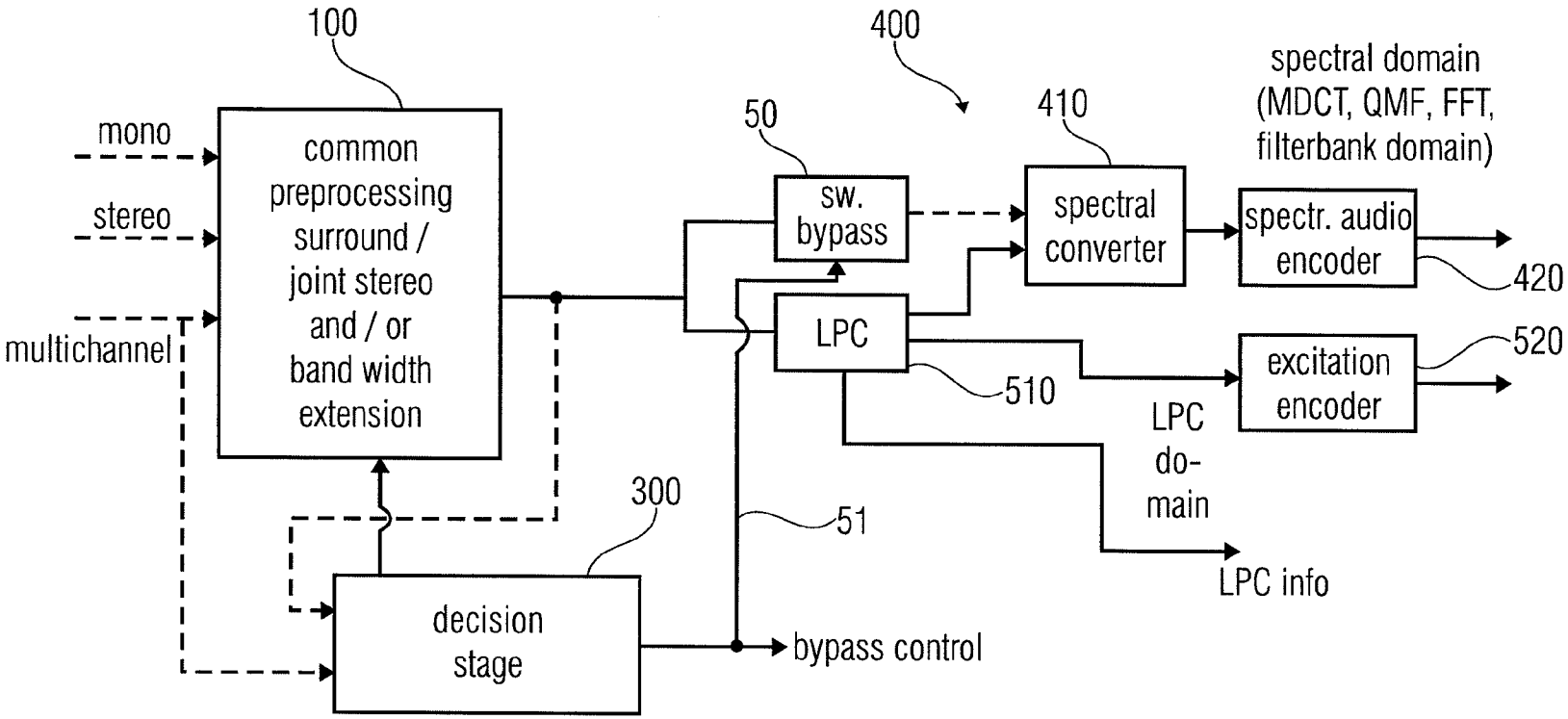
FIG. 2*a* is a block diagram of an encoding scheme in accordance with a second aspect of the present invention.

A mono signal, a stereo signal or a multi-channel signal is input into a common preprocessing stage 100 in FIG. 2*a*. The common preprocessing scheme may have a joint stereo functionality, a surround functionality, and/or a bandwidth extension functionality. At the output of block 100 there is a mono channel, a stereo channel or multiple channels which is input into a set of bypass 50 and converter 510 or multiple sets of this type.

The set of bypass 50 and converter 510 can exist for each output of stage 100, when stage 100 has two or more outputs, i.e., when stage 100 outputs a stereo signal or a multi-channel signal. Exemplarily, the first channel of a stereo signal could be a speech channel and the second channel of the stereo signal could be a music channel. In this situation, the decision in the decision stage can be different between the two channels for the same time instant.

The bypass 50 is controlled by a decision stage 300. The decision stage receives, as an input, a signal input into block 100 or a signal output by block 100. Alternatively, the decision stage 300 may also receive a side information which is included in the mono signal, the stereo signal or the multi-channel signal or is at least associated to such a signal, where information is existing, which was, for example, generated when originally producing the mono signal, the stereo signal or the multi-channel signal.

In one embodiment, the decision stage does not control the preprocessing stage 100, and the arrow between block 300 and 100 does not exist. In a further embodiment, the processing in block 100 is controlled to a certain degree by the decision stage 300 in order to set one or more parameters in block 100 based on the decision. This will, however not influence the general algorithm in block 100 so that the main functionality in block 100 is active irrespective of the decision in stage 300.

The decision stage 300 actuates the bypass 50 in order to feed the output of the common preprocessing stage either in a frequency encoding portion 400 illustrated at an upper branch of FIG. 1*a* or into the an LPC-domain converter 510 which can be part of the second encoding portion 500 illustrated at a lower branch in FIG. 2*a* and having elements 510, 520.

In one embodiment, the bypass bypasses a single domain converter. In a further embodiment, there can be additional domain converters for different encoding branches such as a third encoding branch or even a fourth encoding branch or even more encoding branches. In an embodiment with three encoding branches, the third encoding branch could be similar to the second encoding branch, but could include an excitation encoder different from the excitation encoder 520 in the second branch 500. In this embodiment, the second branch comprises the LPC stage 510 and a codebook based excitation encoder such as in ACELP, and the third branch comprises an LPC stage and an excitation encoder operating on a spectral representation of the LPC stage output signal.

A key element of the frequency domain encoding branch is a spectral conversion block 410 which is operative to convert the common preprocessing stage output signal into a spectral domain. The spectral conversion block may include an MDCT algorithm, a QMF, an FFT algorithm, Wavelet analysis or a filterbank such as a critically sampled filterbank having a certain number of filterbank channels, where the subband signals in this filterbank may be real valued signals or complex valued signals. The output of the spectral conversion block 410 is encoded using a spectral audio encoder 420, which may include processing blocks as known from the AAC coding scheme.

In the lower encoding branch 500, a key element is a source model analyzer such as LPC 510, which is, in this embodiment, the domain converter 510, and which outputs two kinds of signals. One signal is an LPC information signal which is used for controlling the filter characteristic of an LPC synthesis filter. This LPC information is transmitted to a decoder. The other LPC stage 510 output signal is an excitation signal or an LPC-domain signal, which is input into an excitation encoder 520. The excitation encoder 520 may come from any source-filter model encoder such as a CELP encoder, an ACELP encoder or any other encoder which processes a LPC domain signal.

Another advantageous excitation encoder implementation is a transform coding of the excitation signal or an LPC domain signal. In this embodiment, the excitation signal is not encoded using an ACELP codebook mechanism, but the excitation signal is converted into a spectral representation and the spectral representation values such as subband signals in case of a filterbank or frequency coefficients in case of a transform such as an FFT are encoded to obtain a data compression. An implementation of this kind of excitation encoder is the TCX coding mode known from AMR-WB+. This mode is obtained by connecting the LPC stage 510 output to the spectral converter 410. The TCX mode as known from 3GPP TS 26.290 incurs a processing of a perceptually weighted signal in the transform domain. A Fourier transformed weighted signal is quantized using a split multi-rate lattice quantization (algebraic VQ) with noise factor quantization. A transform is calculated in 1024, 512, or 256 sample windows. The excitation signal is recovered by inverse filtering the quantized weighted signal through an inverse weighting filter.

In FIG. 1*a* or FIG. 1*c* the LPC block 510 is followed by an time domain encoder, which may be an ACELP block or a transform domain encoder, which may be a TCX block 527. ACELP is described in 3GPP TS 26.190 and TCX is described in 3GPP TS 26.290. Generally, the ACELP block receives an LPC excitation signal as calculated by a procedure as described in FIG. 7*e*. The TCX block 527 receives a weighted signal as generated by FIG. 7*f*.

In TCX, the transform is applied to the weighted signal computed by filtering the input signal through an LPC-based weighting filter. The weighting filter used advantageous embodiments of the invention is given by $(1-A(z/\gamma))/(1-\mu z^{-1})$. Thus, the weighted signal is an LPC domain signal and its transform is an LPC-spectral domain. The signal processed by ACELP block 526 is the excitation signal and is different from the signal processed by the block 527, but both signals are in the LPC domain.

At the decoder side, after the inverse spectral transform, the inverse of the weighting filter is applied, that is $(1-\mu z^{-1})/A(z/\gamma)$. Then, the signal is filtered through $(1-A(z))$ to go to the LPC excitation domain. Thus, the conversion to LPC domain and a $TCX^{-1}$ operation include an inverse transform and then a filtering through $$\frac{(1-\mu z^{-1})}{(1-A(z/\gamma))}(1-A(z))$$

to convert from the weighted signal domain to the excitation domain.

Although item 510 illustrates a single block, block 510 can output different signals as long as these signals are in the LPC domain. The actual mode of block 510 such as the excitation signal mode or the weighted signal mode can depend on the actual switch state. Alternatively, the block 510 can have two parallel processing devices, where one device is implemented similar to FIG. 7*e* and the other device is implemented as FIG. 7*f*. Hence, the LPC domain at the output of 510 can represent either the LPC excitation signal or the LPC weighted signal or any other LPC domain signal.

In the LPC mode, when the bypass is inactive, i.e., when there is an ACELP/TCX coding, the signal is advantageously pre-emphasized through a filter $1-0.68z^{-1}$ before encoding. At the ACELP/TCX decoder the synthesized signal is deemphasized with the filter $1/1-0.68z^{-1})$. The preemphasis can be part of the LPC block 510 where the signal is preemphasized before LPC analysis and quantization. Similarly, deemphasis can be part of the LPC synthesis block $LPC^{-1}$ 540.

There exist several LPC domains. A first LPC domain represents the LPC excitation, and the second LPC domain represents the LPC weighted signal. That is, the first LPC domain signal is obtained by filtering through $(1-A(z))$ to convert to the LPC residual/excitation domain, while the second LPC domain signal is obtained by filtering through the filter $(1-A(z/\gamma))/(1-\mu z^{-1})$ to convert to the LPC weighted domain.

The decision in the decision stage can be signal-adaptive so that the decision stage performs a music/speech discrimination and controls the bypass 50 and if present, the switch 200 in FIG. 1*c* in such a way that music signals are input into the upper branch 400, and speech signals are input into the lower branch 500. In one embodiment, the decision stage is feeding its decision information into an output bit stream so that a decoder can use this decision information in order to perform the correct decoding operations.

Figure 2B:
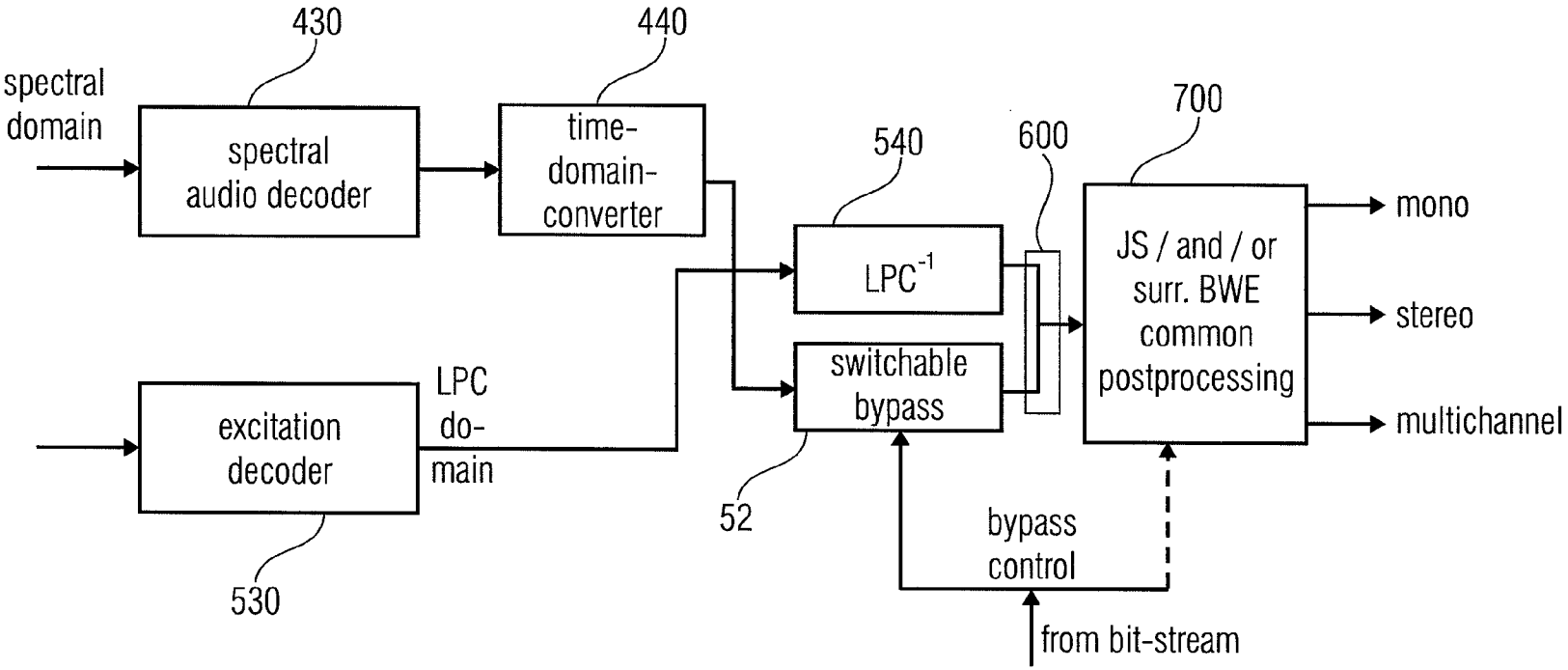
FIG. 2*b* is a schematic diagram of a decoding scheme in accordance with the second aspect of the present invention.

Such a decoder is illustrated in FIG. 2*b*. The signal output by the spectral audio encoder 420 is, after transmission, input into a spectral audio decoder 430. The output of the spectral audio decoder 430 is input into a time-domain converter 440. Analogously, the output of the excitation encoder 520 of FIG. 2*a* is input into an excitation decoder 530 which outputs an LPC-domain signal. The LPC-domain signal is input into an LPC synthesis stage 540, which receives, as a further input, the LPC information generated by the corresponding LPC analysis stage 510. The output of the time-domain converter 440 and/or the output of the LPC synthesis stage 540 are input into a switchable bypass 52. The bypass 52 is controlled via a bypass control signal which was, for example, generated by the decision stage 300, or which was externally provided such as by a creator of the original mono signal, stereo signal or multi-channel signal.

The output of the bypass 540 or stage 540 is input into the combiner 600 is a complete mono signal which is, subsequently, input into a common post-processing stage 700, which may perform a joint stereo processing or a bandwidth extension processing etc. Depending on the specific functionality of the common post-processing stage, a mono signal, a stereo signal or a multi-channel signal is output which has, when the common post-processing stage 700 performs a bandwidth extension operation, a larger bandwidth than the signal input into block 700.

In one embodiment, the bypass 52 is adapted to bypass the single converter 540. In a further embodiment, there can be additional converters defining additional decoding branches such as a third decoding branch or even a fourth decoding branch or even more decoding branches. In an embodiment with three decoding branches, the third decoding branch could be similar to the second decoding branch, but could include an excitation decoder different from the excitation decoder 530 in the second branch 530, 540. In this embodiment, the second branch comprises the LPC stage 540 and a codebook based excitation decoder such as in ACELP, and the third branch comprises an LPC stage and an excitation decoder operating on a spectral representation of the LPC stage 540 output signal.

Figure 2C:
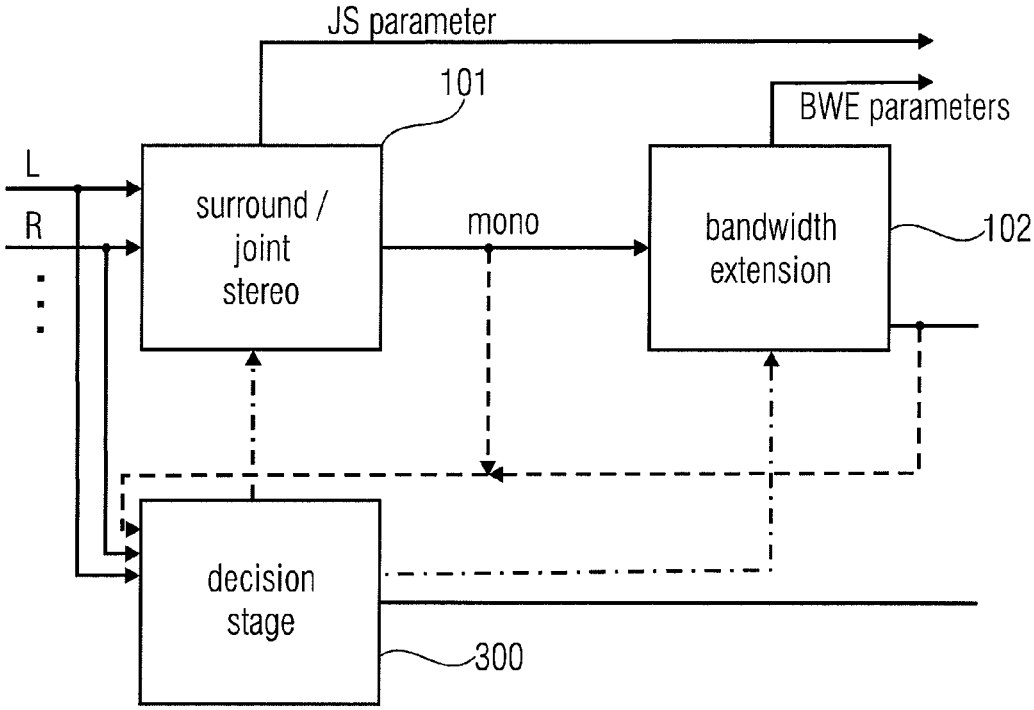
FIG. 2*c* is a block diagram of an advantageous common pre-processing of FIG. 2*a*.

As stated before, FIG. 2*c* illustrates an advantageous encoding scheme in accordance with a second aspect of the invention. The common preprocessing scheme in 100 from FIG. 1*a* now comprises a surround/joint stereo block 101 which generates, as an output, joint stereo parameters and a mono output signal, which is generated by downmixing the input signal which is a signal having two or more channels. Generally, the signal at the output of block 101 can also be a signal having more channels, but due to the downmixing functionality of block 101, the number of channels at the output of block 101 will be smaller than the number of channels input into block 101.

The output of block 101 is input into a bandwidth extension block 102 which, in the encoder of FIG. 2*c*, outputs a bandlimited signal such as the low band signal or the low pass signal at its output. Furthermore, for the high band of the signal input into block 102, bandwidth extension parameters such as spectral envelope parameters, inverse filtering parameters, noise floor parameters etc. as known from HE-AAC profile of MPEG-4 are generated and forwarded to a bitstream multiplexer 800.

Advantageously, the decision stage 300 receives the signal input into block 101 or input into block 102 in order to decide between, for example, a music mode or a speech mode. In the music mode, the upper encoding branch 400 is selected, while, in the speech mode, the lower encoding branch 500 is selected. Advantageously, the decision stage additionally controls the joint stereo block 101 and/or the bandwidth extension block 102 to adapt the functionality of these blocks to the specific signal. Thus, when the decision stage determines that a certain time portion of the input signal is of the first mode such as the music mode, then specific features of block 101 and/or block 102 can be controlled by the decision stage 300. Alternatively, when the decision stage 300 determines that the signal is in a speech mode or, generally, in a LPC-domain coding mode, then specific features of blocks 101 and 102 can be controlled in accordance with the decision stage output.

Depending on the decision of the switch, which can be derived from the switch 200 input signal or from any external source such as a producer of the original audio signal underlying the signal input into stage 200, the switch switches between the frequency encoding branch 400 and the LPC encoding branch 500. The frequency encoding branch 400 comprises a spectral conversion stage and a subsequently connected quantizing/coding stage. The quantizing/coding stage can include any of the functionalities as known from modern frequency-domain encoders such as the AAC encoder. Furthermore, the quantization operation in the quantizing/coding stage can be controlled via a psychoacoustic module which generates psychoacoustic information such as a psychoacoustic masking threshold over the frequency, where this information is input into the stage.

Advantageously, the spectral conversion is done using an MDCT operation which, even more advantageously, is the time-warped MDCT operation, where the strength or, generally, the warping strength can be controlled between zero and a high warping strength. In a zero warping strength, the MDCT operation in block 400 in FIG. 1*c* is a straight-forward MDCT operation known in the art. The time warping strength together with time warping side information can be transmitted/input into the bitstream multiplexer 800 as side information. Therefore, if TW-MDCT is used, time warp side information should be sent to the bitstream as illustrated by 424 in FIG. 1*c*, and—on the decoder side—time warp side information should be received from the bitstream as illustrated by item 434 in FIG. 1*d*.

In the LPC encoding branch, the LPC-domain encoder may include an ACELP core calculating a pitch gain, a pitch lag and/or codebook information such as a codebook index and a code gain.

In the first coding branch 400, a spectral converter advantageously comprises a specifically adapted MDCT operation having certain window functions followed by a quantization/entropy encoding stage which may be a vector quantization stage, but advantageously is a quantizer/coder similar to the quantizer/coder in the frequency domain coding branch.

Figure 2D:
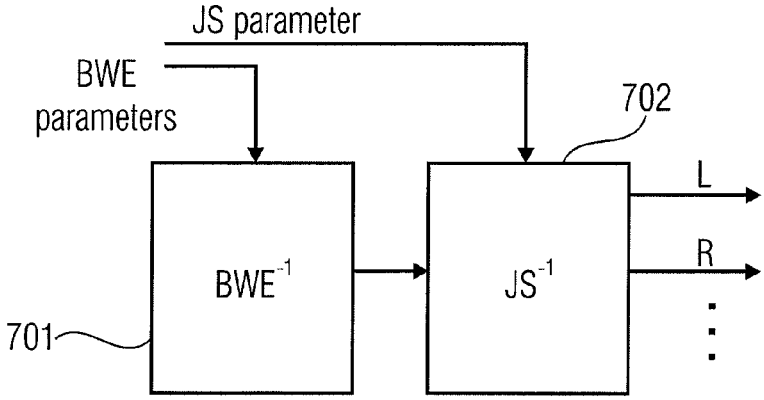
FIG. 2*d* is a block diagram of an advantageous common post-processing of FIG. 2*b;*

FIG. 2*d* illustrates a decoding scheme corresponding to the encoding scheme of FIG. 2*c*. The bitstream generated by a bitstream multiplexer is input into a bitstream demultiplexer. Depending on an information derived for example from the bitstream via a mode detection block, a decoder-side switch is controlled to either forward signals from the upper branch or signals from the lower branch to the bandwidth extension block 701. The bandwidth extension block 701 receives, from the bitstream demultiplexer, side information and, based on this side information and the output of the mode decision, reconstructs the high band based on the low band output by combiner 600 from FIG. 1*d* for example.

The full band signal generated by block 701 is input into the joint stereo/surround processing stage 702, which reconstructs two stereo channels or several multi-channels. Generally, block 702 will output more channels than were input into this block. Depending on the application, the input into block 702 may even include two channels such as in a stereo mode and may even include more channels as long as the output by this block has more channels than the input into this block.

Figure 4A:
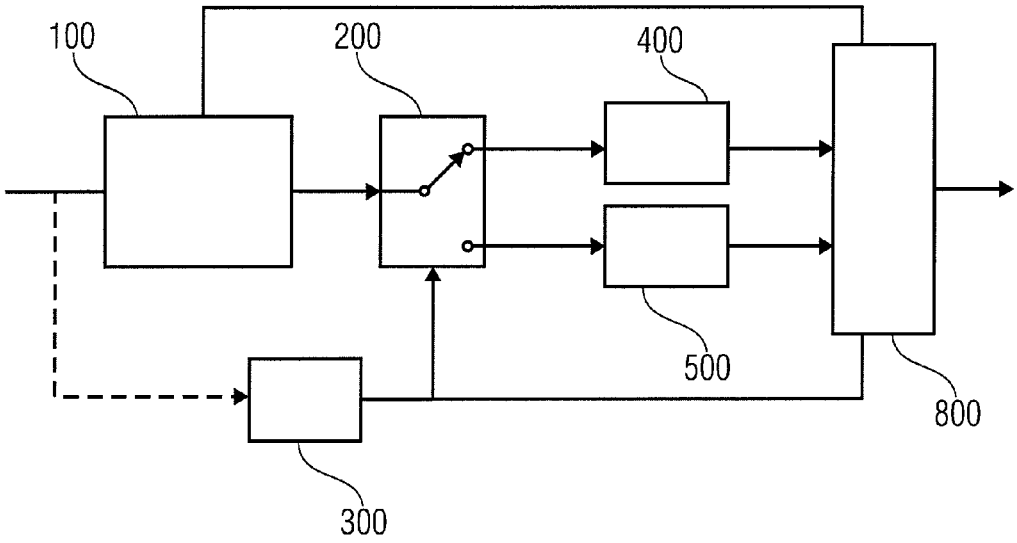
FIG. 4*a* illustrates a block diagram with a switch positioned before the encoding branches.
Figure 4B:
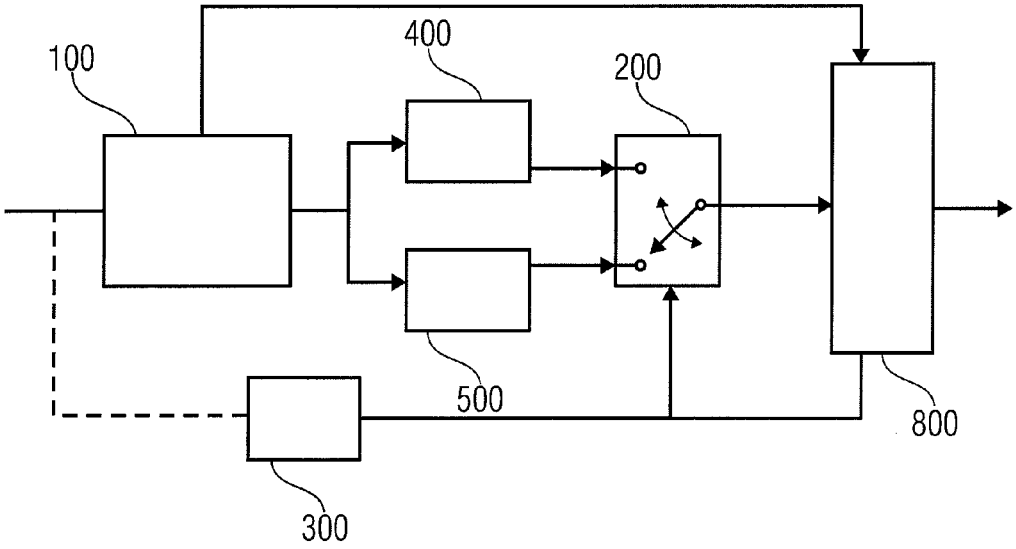
FIG. 4*b* illustrates a block diagram of an encoding scheme with the switch positioned subsequent to encoding the branches.

The switch 200 in FIG. 1*c* has been shown to switch between both branches so that only one branch receives a signal to process and the other branch does not receive a signal to process as shown generally in FIG. 4*a*. In an alternative embodiment illustrated in FIG. 4*b*, however, the switch may also be arranged subsequent to for example the audio encoder 420 and the excitation encoder 520, which means that both branches 400, 500 process the same signal in parallel. In order to not double the bitrate, however, only the signal output by one of those encoding branches 400 or 500 is selected to be written into the output bitstream. The decision stage will then operate so that the signal written into the bitstream minimizes a certain cost function, where the cost function can be the generated bitrate or the generated perceptual distortion or a combined rate/distortion cost function. Therefore, either in this mode or in the mode illustrated in the Figures, the decision stage can also operate in a closed loop mode in order to make sure that, finally, only the encoding branch output is written into the bitstream which has for a given perceptual distortion the lowest bitrate or, for a given bitrate, has the lowest perceptual distortion.

Generally, the processing in branch 400 is a processing in a perception based model or information sink model. Thus, this branch models the human auditory system receiving sound. Contrary thereto, the processing in branch 500 is to generate a signal in the excitation, residual or LPC domain. Generally, the processing in branch 500 is a processing in a speech model or an information generation model. For speech signals, this model is a model of the human speech/sound generation system generating sound. If, however, a sound from a different source requiring a different sound generation model is to be encoded, then the processing in branch 500 may be different.

Although FIGS. 1*a* through 4*c* are illustrated as block diagrams of an apparatus, these figures simultaneously are an illustration of a method, where the block functionalities correspond to the method steps.

Figure 3A:
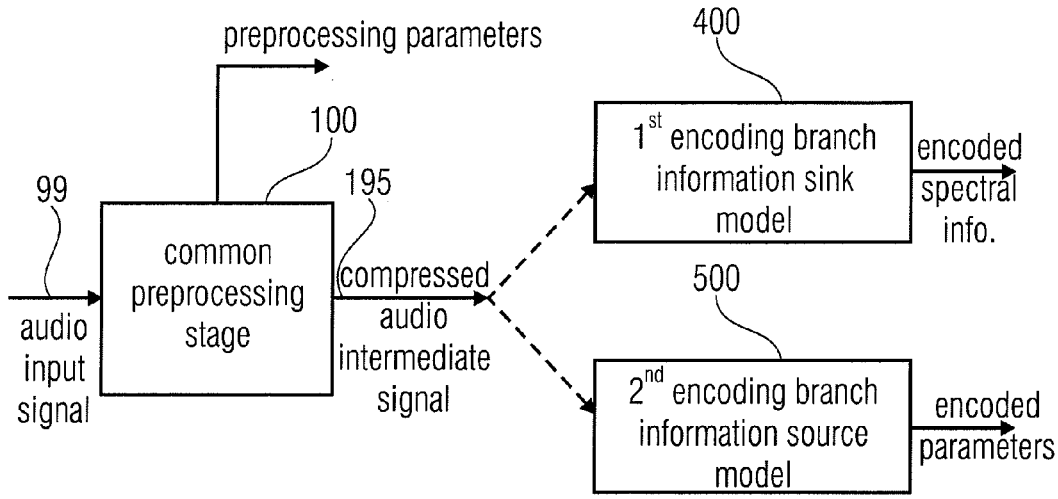
FIG. 3*a* illustrates a block diagram of an encoding scheme in accordance with a further aspect of the present invention.
Figure 3B:
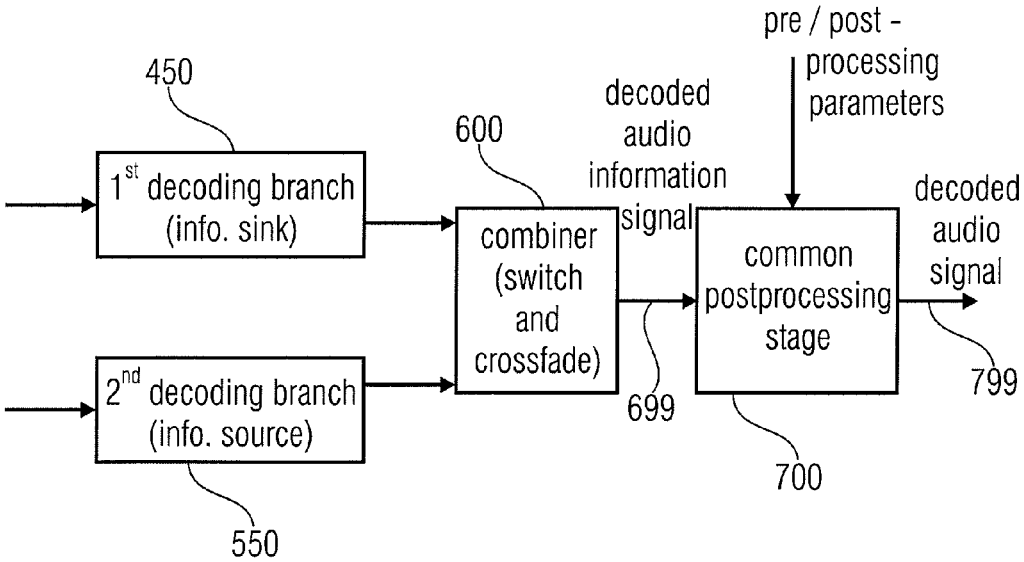
FIG. 3*b* illustrates a block diagram of a decoding scheme in accordance with the further aspect of the present invention.
Figure 3C:
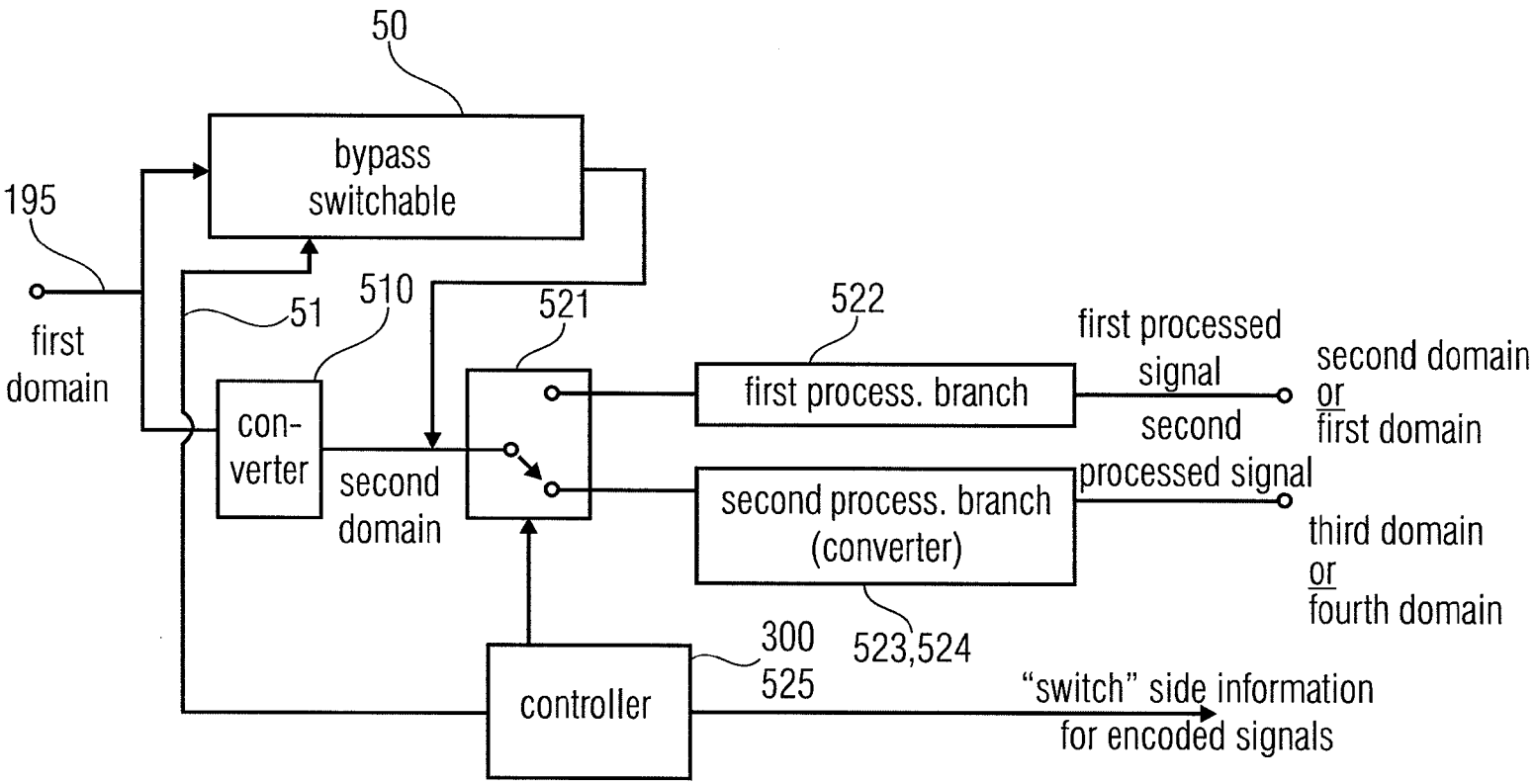
FIG. 3*c* illustrates a schematic representation of the encoding apparatus/method with cascaded switches.

FIG. 3*c* illustrates an audio encoder for encoding an audio input signal 195. The audio input signal 195 is present in a first domain which can, for example, be the time domain but which can also be any other domain such as a frequency domain, an LCP domain, an LPC spectral domain or any other domain. Generally, the conversion from one domain to the other domain is performed by a kind of a conversion algorithm such as any of the well-known time/frequency conversion algorithms or frequency/time conversion algorithms.

An alternative transform from the time domain, for example in the LPC domain is the result of LPC-based filtering a time domain signal which results in an LPC residual signal or excitation signal, or other LPC domain signal. Any other filtering operations producing a filtered signal which has an impact on a substantial number of signal samples before the transform can be used as a transform algorithm as the case may be. Therefore, weighting an audio signal using an LPC based weighting filter is a further transform, which generates a signal in the LPC domain. In a time/frequency transform, the modification of a single spectral value will have an impact on all time domain values before the transform. Analogously, a modification of any time domain sample will have an impact on each frequency domain sample. Similarly, a modification of a sample of the excitation signal in an LPC domain situation will have, due to the length of the LPC filter, an impact on a substantial number of samples before the LPC filtering. Similarly, a modification of a sample before an LPC transformation will have an impact on many samples obtained by this LPC transformation due to the inherent memory effect of the LPC filter.

The audio encoder of FIG. 3*c* includes a first coding branch 522 which generates a first encoded signal. This first encoded signal may be in a fourth domain which is, in the advantageous embodiment, the time-spectral domain, i.e., the domain which is obtained when a time domain signal is processed via a time/frequency conversion.

Therefore, the first coding branch 522 for encoding an audio signal uses a first coding algorithm to obtain a first encoded signal, where this first coding algorithm may or may not include a time/frequency conversion algorithm.

The audio encoder furthermore includes a second coding branch 523 for encoding an audio signal. The second coding branch 523 uses a second coding algorithm to obtain a second encoded signal, which is different from the first coding algorithm.

The audio encoder furthermore includes a first switch 521 for switching between the first coding branch 522 and the second coding branch 523, 524 so that for a portion of the audio input signal, either the first encoded signal at the output of block 522 or the second encoded signal at the output of the second encoding branch is included in an encoder output signal. Thus, when for a certain portion of the audio input signal 195, the first encoded signal in the fourth domain is included in the encoder output signal, the second encoded signal which is either the first processed signal in the second domain or the second processed signal in the third domain is not included in the encoder output signal. This makes sure that this encoder is bit rate efficient. In embodiments, any time portions of the audio signal which are included in two different encoded signals are small compared to a frame length of a frame as will be discussed in connection with FIG. 3*e*. These small portions are useful for a cross fade from one encoded signal to the other encoded signal in the case of a switch event in order to reduce artifacts that might occur without any cross fade. Therefore, apart from the cross-fade region, each time domain block is represented by an encoded signal of only a single domain.

As illustrated in FIG. 3*c*, the second coding branch 523 follows a converter 521 for converting the audio signal in the first domain, i.e., signal 195 into a second domain, and the bypass 50. Furthermore, the first processing branch 522 obtains a first processed signal which is, advantageously, also in the second domain so that the first processing branch 522 does not perform a domain change, or which is in the first domain.

The second encoding branch 523, 524 converts the audio signal into a third domain or a fourth domain, which is different from the first domain and which is also different from the second domain to obtain a second processed signal at the output of the second processing branch 523, 524.

Furthermore, the coder comprises a switch 521 for switching between the first processing branch 522 and the second processing branch 523, 524, where this switch corresponds to the switch 200 of FIG. 1*c*.

Figure 3D:
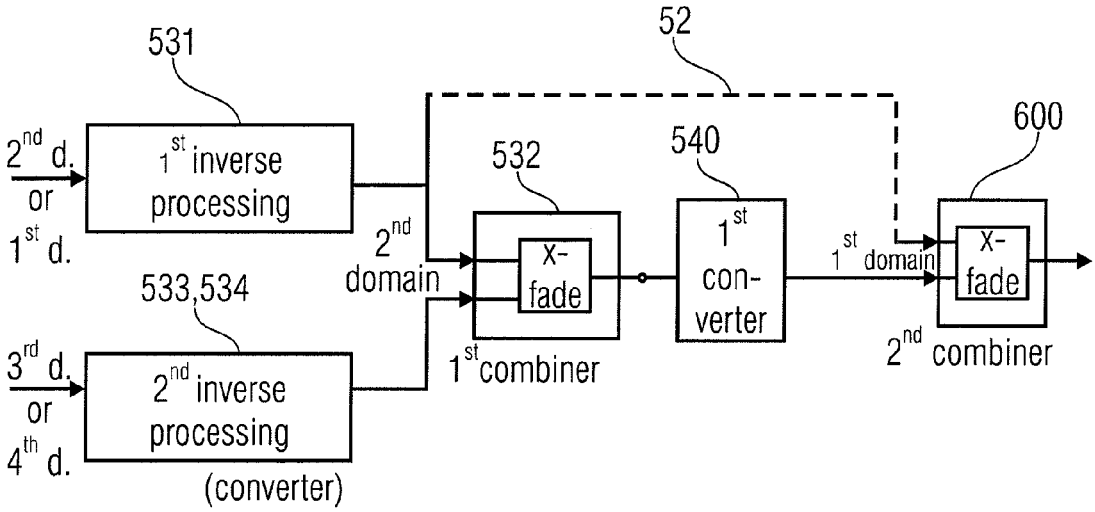
FIG. 3*d* illustrates a schematic diagram of an apparatus or method for decoding, in which cascaded combiners are used.

FIG. 3*d* illustrates a corresponding decoder for decoding an encoded audio signal generated by the encoder of FIG. 3*c*. Generally, each block of the first domain audio signal is represented by either a second or first domain signal, or a third or fourth domain encoded signal apart from an optional cross fade region which is, advantageously, short compared to the length of one frame in order to obtain a system which is as much as possible at the critical sampling limit. The encoded audio signal includes the first coded signal, a second coded signal, wherein the first coded signal, and the second coded signal relate to different time portions of the decoded audio signal and wherein the second domain, the third domain and the first domain for a decoded audio signal are different from each other.

The decoder comprises a first decoding branch for decoding based on the first coding algorithm. The first decoding branch is illustrated at 531 in FIG. 3*d*.

The decoder of FIG. 3*d* furthermore comprises a second decoding branch 533, 534 which comprises several elements.

The decoder furthermore comprises a first combiner 532 for combining the first inverse processed signal and the second inverse processed signal to obtain a signal in the first or the second domain, where this combined signal is, at the first time instant, only influenced by the first inverse processed signal and is, at a later time instant, only influenced by the second inverse processed signal.

The decoder furthermore comprises the converter 540 for converting the combined signal to the first domain and the switchable bypass 52.

Finally, the decoder illustrated in FIG. 3*d* comprises a second combiner 600 for combining the decoded first signal from bypass 52 and the converter 540 output signal to obtain a decoded output signal in the first domain. Again, the decoded output signal in the first domain is, at the first time instant, only influenced by the signal output by the converter 540 and is, at a later time instant, only influenced by bypassed signal.

Figure 3E:
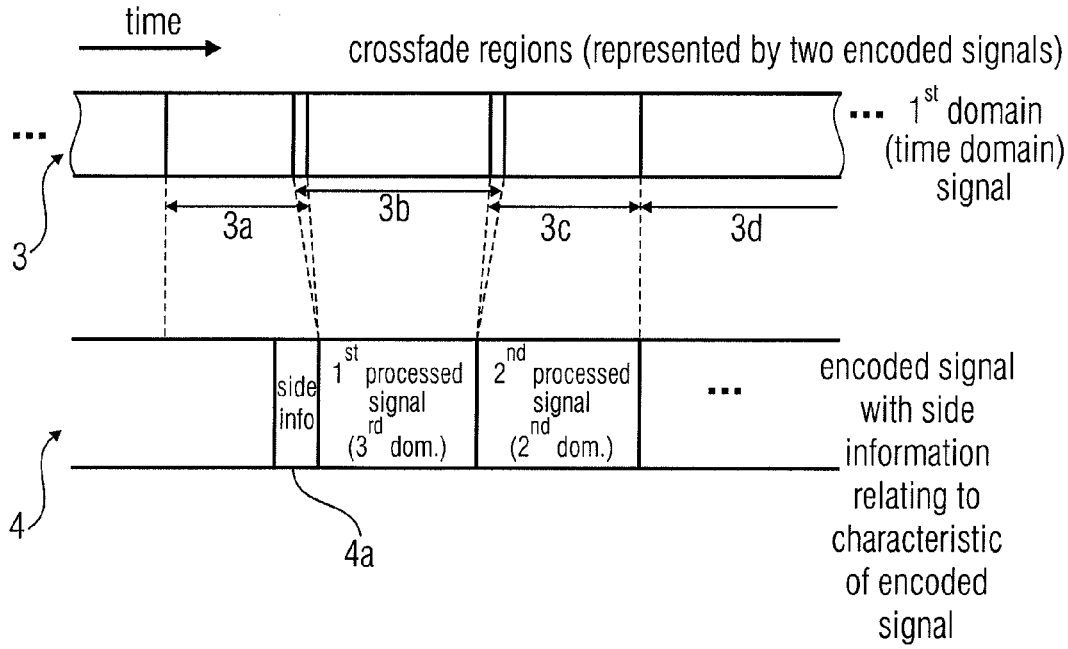
FIG. 3*e* illustrates an illustration of a time domain signal and a corresponding representation of the encoded signal illustrating short cross fade regions which are included in both encoded signals.

This situation is illustrated, from an encoder perspective, in FIG. 3*e*. The upper portion in FIG. 3*e* illustrates in the schematic representation, a first domain audio signal such as a time domain audio signal, where the time index increases from left to right and item might be considered as a stream of audio samples representing the signal 195 in FIG. 3*c*. FIG. 3*e* illustrates frames 3*a*, 3*b*, 3*c*, 3*d* which may be generated by switching between the first encoded signal and the second encoded signal as illustrated at item 4 in FIG. 3*e*. The first encoded signal and the second encoded signal are all in different domains. In order to make sure that the switching between the different domains does not result in an artifact on the decoder-side, frames 3*a*, 3*b*, 3*c*, . . . of the time domain signal have an overlapping range which is indicated as a cross fade region. However, no such cross fade region is existing between frame 3*d*, 3*c* which means that frame 3*d* might also be represented by a signal in the same domain as the preceding signal 3*c*, and there is no domain change between frame 3*c* and 3*d*.

Therefore, generally, it is advantageous not to provide a cross fade region where there is no domain change and to provide a cross fade region, i.e., a portion of the audio signal which is encoded by two subsequent coded/processed signals when there is a domain change, i.e., a switching action of either of the two switches.

In the embodiment, in which the first encoded signal or the second processed signal has been generated by an MDCT processing having e.g. 50 percents overlap, each time domain sample is included in two subsequent frames. Due to the characteristics of the MDCT, however, this does not result in an overhead, since the MDCT is a critically sampled system. In this context, critically sampled means that the number of spectral values is the same as the number of time domain values. The MDCT is advantageous in that the crossover effect is provided without a specific crossover region so that a crossover from an MDCT block to the next MDCT block is provided without any overhead which would violate the critical sampling requirement.

Advantageously, the first coding algorithm in the first coding branch is based on an information sink model, and the second coding algorithm in the second coding branch is based on an information source or an SNR model. An SNR model is a model which is not specifically related to a specific sound generation mechanism but which is one coding mode which can be selected among a plurality of coding modes based e.g. on a closed loop decision. Thus, an SNR model is any available coding model but which does not necessarily have to be related to the physical constitution of the sound generator but which is any parameterized coding model different from the information sink model, which can be selected by a closed loop decision and, specifically, by comparing different SNR results from different models.

As illustrated in FIG. 3*c*, a controller 300, 525 is provided. This controller may include the functionalities of the decision stage 300 of FIG. 1*c*. Generally, the controller is for controlling the bypass and the switch 200 in FIG. 1*c* in a signal adaptive way. The controller is operative to analyze a signal input into the bypass or output by the first or the second coding branch or signals obtained by encoding and decoding from the first and the second encoding branch with respect to a target function. Alternatively, or additionally, the controller is operative to analyze the signal input into the switch or output by the first processing branch or the second processing branch or obtained by processing and inverse processing from the first processing branch and the second processing branch, again with respect to a target function.

In one embodiment, the first coding branch or the second coding branch comprises an aliasing introducing time/frequency conversion algorithm such as an MDCT or an MDST algorithm, which is different from a straightforward FFT transform, which does not introduce an aliasing effect. Furthermore, one or both branches comprise a quantizer/entropy coder block. Specifically, only the second processing branch of the second coding branch includes the time/frequency converter introducing an aliasing operation and the first processing branch of the second coding branch comprises a quantizer and/or entropy coder and does not introduce any aliasing effects. The aliasing introducing time/frequency converter advantageously comprises a windower for applying an analysis window and an MDCT transform algorithm. Specifically, the windower is operative to apply the window function to subsequent frames in an overlapping way so that a sample of a windowed signal occurs in at least two subsequent windowed frames.

In one embodiment, the first processing branch comprises an ACELP coder and a second processing branch comprises an MDCT spectral converter and the quantizer for quantizing spectral components to obtain quantized spectral components, where each quantized spectral component is zero or is defined by one quantizer index of the plurality of different possible quantizer indices.

As stated before, both coding branches are operative to encode the audio signal in a block wise manner, in which the bypass or the switch operate in a block-wise manner so that a switching or bypassing action takes place, at the minimum, after a block of a predefined number of samples of a signal, the predefined number forming a frame length for the corresponding switch. Thus, the granule for bypassing by the bypass may be, for example, a block of 2048 or 1028 samples, and the frame length, based on which the bypass is switching may be variable but is, advantageously, fixed to such a quite long period.

Contrary thereto, the block length for the switch 200, i.e., when the switch 200 switches from one mode to the other, is substantially smaller than the block length for the first switch. Advantageously, both block lengths for the switches are selected such that the longer block length is an integer multiple of the shorter block length. In the advantageous embodiment, the block length of the first switch is 2048 and the block length of the second switch is 1024 or more advantageously, 512 and even more advantageously, 256 and even more advantageously 256 or even 128 samples so that, at the maximum, the switch can switch 16 times when the bypass changes only a single time.

In a further embodiment, the controller 300 is operative to perform a speech music discrimination for the first switch in such a way that a decision to speech is favored with respect to a decision to music. In this embodiment, a decision to speech is taken even when a portion less than 50% of a frame for the first switch is speech and the portion of more than 50% of the frame is music.

Furthermore, the controller is operative to already switch to the speech mode, when a quite small portion of the first frame is speech and, specifically, when a portion of the first frame is speech, which is 50% of the length of the smaller second frame. Thus, an advantageous speech/favouring switching decision already switches over to speech even when, for example, only 6% or 12% of a block corresponding to the frame length of the first switch is speech.

This procedure is advantageously in order to fully exploit the bit rate saving capability of the first processing branch, which has a voiced speech core in one embodiment and to not loose any quality even for the rest of the large first frame, which is non-speech due to the fact that the second processing branch includes a converter and, therefore, is useful for audio signals which have non-speech signals as well. Advantageously, this second processing branch includes an overlapping MDCT, which is critically sampled, and which even at small window sizes provides a highly efficient and aliasing free operation due to the time domain aliasing cancellation processing such as overlap and add on the decoder-side. Furthermore, a large block length for the first encoding branch which is advantageously an AAC-like MDCT encoding branch is useful, since non-speech signals are normally quite stationary and a long transform window provides a high frequency resolution and, therefore, high quality and, additionally, provides a bit rate efficiency due to a psycho acoustically controlled quantization module, which can also be applied to the transform based coding mode in the second processing branch of the second coding branch.

Regarding the FIG. 3*d* decoder illustration, it is advantageous that the transmitted signal includes an explicit indicator as side information 4*a* as illustrated in FIG. 3*e*. This side information 4*a* is extracted by a bit stream parser not illustrated in FIG. 3*d* in order to forward the corresponding first processed signal or second processed signal to the correct processor such as the first inverse processing branch or the second inverse processing branch in FIG. 3*d*. Therefore, an encoded signal not only has the encoded/processed signals but also includes side information relating to these signals. In other embodiments, however, there can be an implicit signaling which allows a decoder-side bit stream parser to distinguish between the certain signals. Regarding FIG. 3*e*, it is outlined that the first processed signal or the second processed signal is the output of the second coding branch and, therefore, the second coded signal.

Advantageously, the first decoding branch and/or the second inverse processing branch includes an MDCT transform for converting from the spectral domain to the time domain. To this end, an overlap-adder is provided to perform a time domain aliasing cancellation functionality which, at the same time, provides a cross fade effect in order to avoid blocking artifacts. Generally, the first decoding branch converts a signal encoded in the fourth domain into the first domain, while the second inverse processing branch performs a conversion from the third domain to the second domain and the converter subsequently connected to the first combiner provides a conversion from the second domain to the first domain so that, at the input of the combiner 600, only first domain signals are there, which represent, in the FIG. 3*d* embodiment, the decoded output signal.

Figure 4C:
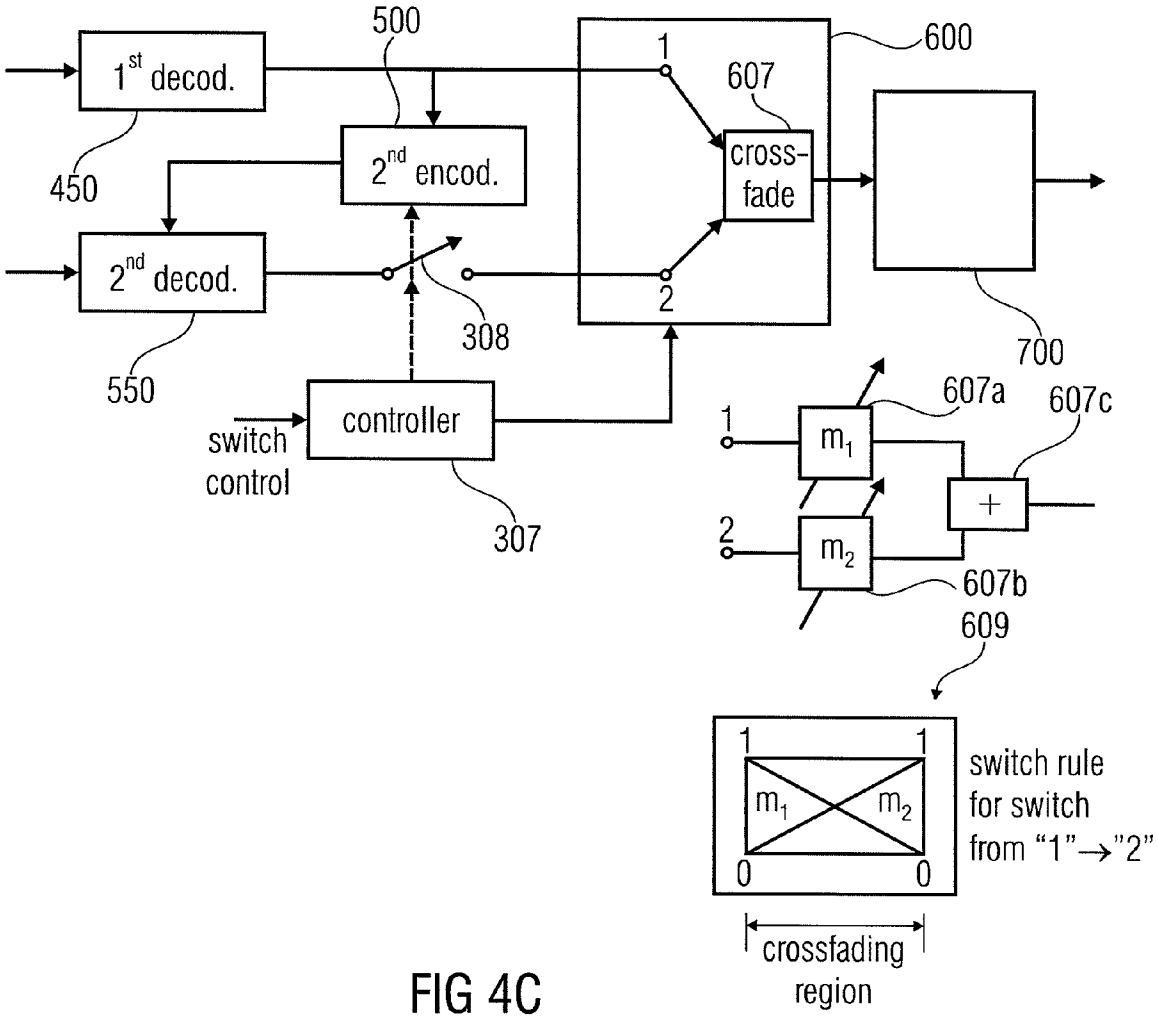
FIG. 4*c* illustrates a block diagram for an advantageous combiner embodiment.

FIG. 4*c* illustrates a further aspect of an advantageous decoder implementation. In order to avoid audible artefacts specifically in the situation, in which the first decoder is a time-aliasing generating decoder or generally stated a frequency domain decoder and the second decoder is a time domain device, the borders between blocks or frames output by the first decoder 450 and the second decoder 550 should not be fully continuous, specifically in a switching situation. Thus, when the first block of the first decoder 450 is output and, when for the subsequent time portion, a block of the second decoder is output, it is advantageous to perform a cross fading operation as illustrated by cross fade block 607. To this end, the cross fade block 607 might be implemented as illustrated in FIG. 4*c* at 607*a*, 607*b* and 607*c*. Each branch might have a weighter having a weighting factor $m_1$ between 0 and 1 on the normalized scale, where the weighting factor can vary as indicated in the plot 609, such a cross fading rule makes sure that a continuous and smooth cross fading takes place which, additionally, assures that a user will not perceive any loudness variations. Non-linear crossfade rules such as a $\sin^2$ crossfade rule can be applied instead of a linear crossfade rule.

In certain instances, the last block of the first decoder was generated using a window where the window actually performed a fade out of this block. In this case, the weighting factor $m_1$ in block 607*a* is equal to 1 and, actually, no weighting at all is required for this branch.

When a switch from the second decoder to the first decoder takes place, and when the second decoder includes a window which actually fades out the output to the end of the block, then the weighter indicated with "$m_2$" would not be required or the weighting parameter can be set to 1 throughout the whole cross fading region.

When the first block after a switch was generated using a windowing operation, and when this window actually performed a fade in operation, then the corresponding weighting factor can also be set to 1 so that a weighter is not really necessary. Therefore, when the last block is windowed in order to fade out by the decoder and when the first block after the switch is windowed using the decoder in order to provide a fade in, then the weighters 607*a*, 607*b* are not required at all and an addition operation by adder 607*c* is sufficient.

In this case, the fade out portion of the last frame and the fade in portion of the next frame define the cross fading region indicated in block 609. Furthermore, it is advantageous in such a situation that the last block of one decoder has a certain time overlap with the first block of the other decoder.

If a cross fading operation is not required or not possible or not desired, and if only a hard switch from one decoder to the other decoder is there, it is advantageous to perform such a switch in silent passages of the audio signal or at least in passages of the audio signal where there is low energy, i.e., which are perceived to be silent or almost silent. Advantageously, the decision stage 300 assures in such an embodiment that the switch 200 is only activated when the corresponding time portion which follows the switch event has an energy which is, for example, lower than the mean energy of the audio signal and is, advantageously, lower than 50% of the mean energy of the audio signal related to, for example, two or even more time portions/frames of the audio signal.

Advantageously, the second encoding rule/decoding rule is an LPC-based coding algorithm. In LPC-based speech coding, a differentiation between quasi-periodic impulse-like excitation signal segments or signal portions, and noise-like excitation signal segments or signal portions, is made. This is performed for very low bit rate LPC vocoders (2.4 kbps) as in FIG. 7*b*. However, in medium rate CELP coders, the excitation is obtained for the addition of scaled vectors from an adaptive codebook and a fixed codebook.

Quasi-periodic impulse-like excitation signal segments, i.e., signal segments having a specific pitch are coded with different mechanisms than noise-like excitation signals. While quasi-periodic impulse-like excitation signals are connected to voiced speech, noise-like signals are related to unvoiced speech.

Figures 5A, 5B:
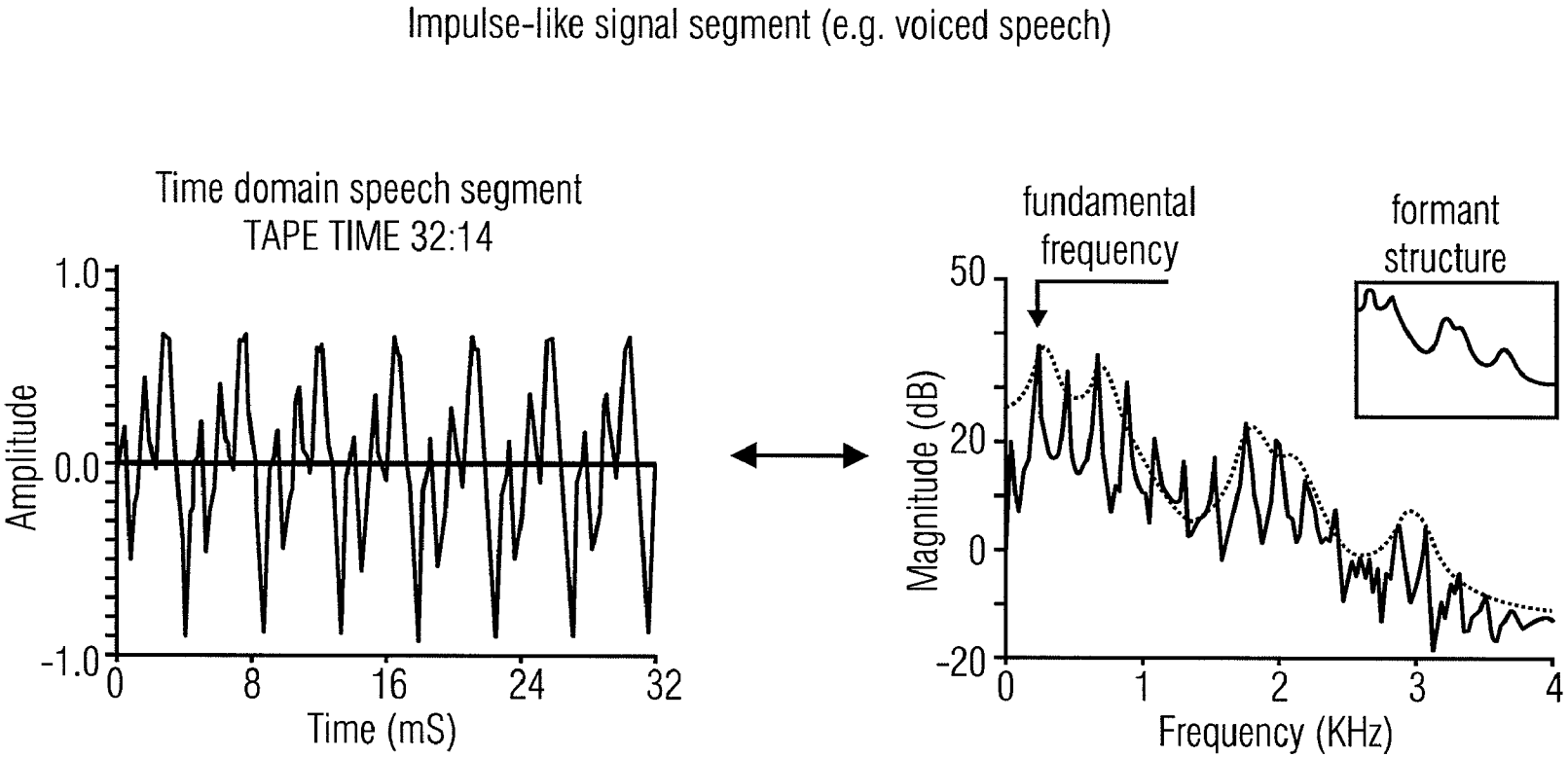
FIG. 5*a* illustrates a wave form of a time domain speech segment as a quasi-periodic or impulse-like signal segment.
FIG. 5*b* illustrates a spectrum of the segment of FIG. 5*a;*

Exemplarily, reference is made to FIGS. 5*a* to 5*d*. Here, quasi-periodic impulse-like signal segments or signal portions and noise-like signal segments or signal portions are exemplarily discussed. Specifically, a voiced speech as illustrated in FIG. 5*a* in the time domain and in FIG. 5*b* in the frequency domain is discussed as an example for a quasi-periodic impulse-like signal portion, and an unvoiced speech segment as an example for a noise-like signal portion is discussed in connection with FIGS. 5*c* and 5*d*. Speech can generally be classified as voiced, unvoiced, or mixed. Time-and-frequency domain plots for sampled voiced and unvoiced segments are shown in FIG. 5*a* to 5*d*. Voiced speech is quasi periodic in the time domain and harmonically structured in the frequency domain, while unvoiced speed is random-like and broadband. The short-time spectrum of voiced speech is characterized by its fine and formant structure. The fine harmonic structure is a consequence of the quasi-periodicity of speech and may be attributed to the vibrating vocal chords. The formant structure (spectral envelope) is due to the interaction of the source and the vocal tracts. The vocal tracts consist of the pharynx and the mouth cavity. The shape of the spectral envelope that "fits" the short time spectrum of voiced speech is associated with the transfer characteristics of the vocal tract and the spectral tilt (6 dB/Octave) due to the glottal pulse. The spectral envelope is characterized by a set of peaks which are called formants. The formants are the resonant modes of the vocal tract. For the average vocal tract there are three to five formants below 5 kHz. The amplitudes and locations of the first three formants, usually occurring below 3 kHz are quite important both, in speech synthesis and perception. Higher formants are also important for wide band and unvoiced speech representations. The properties of speech are related to the physical speech production system as follows. Voiced speech is produced by exciting the vocal tract with quasi-periodic glottal air pulses generated by the vibrating vocal chords. The frequency of the periodic pulses is referred to as the fundamental frequency or pitch. Unvoiced speech is produced by forcing air through a constriction in the vocal tract. Nasal sounds are due to the acoustic coupling of the nasal tract to the vocal tract, and plosive sounds are produced by abruptly releasing the air pressure which was built up behind the closure in the tract.

Figures 5C, 5D:
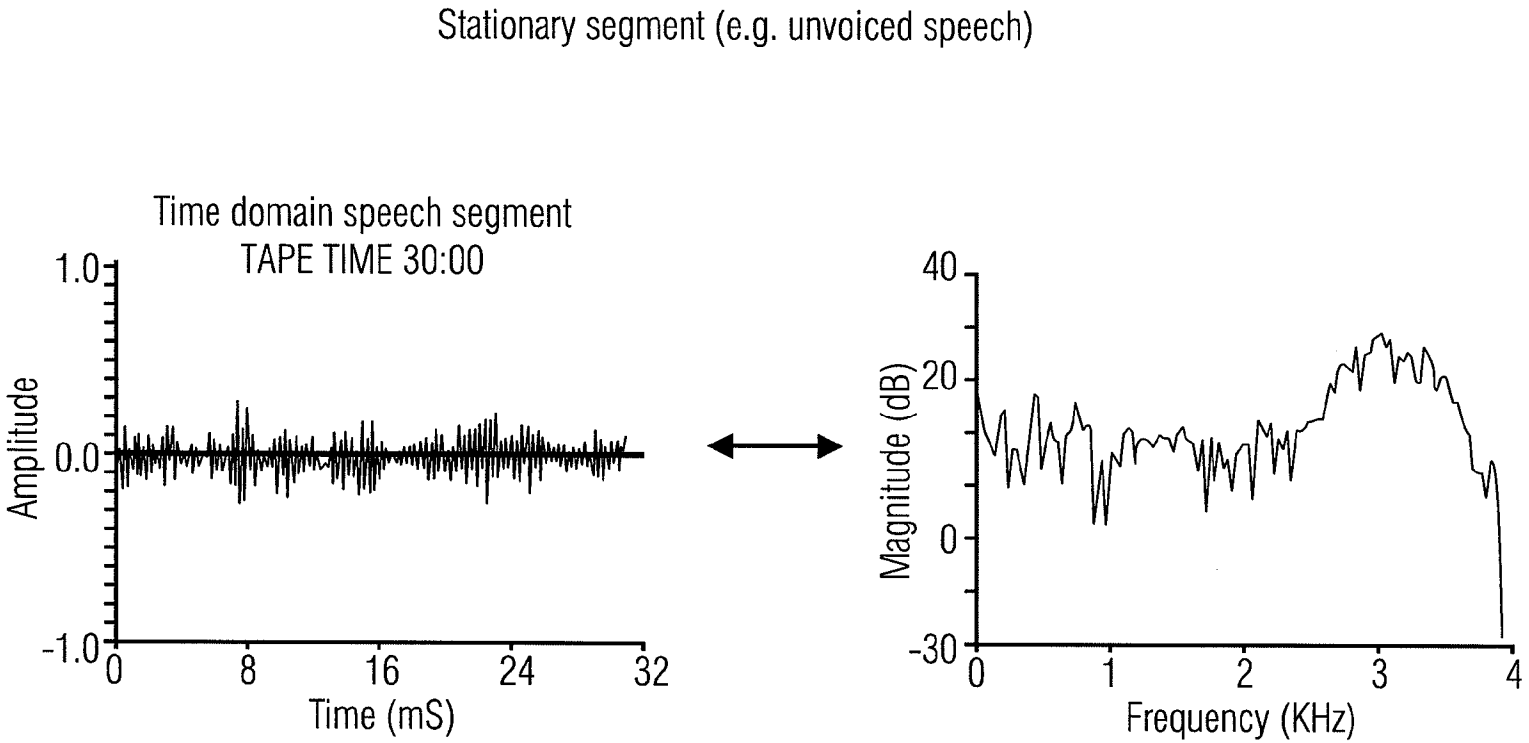
FIG. 5*c* illustrates a time domain speech segment of unvoiced speech as an example for a noise-like or stationary segment.
FIG. 5*d* illustrates a spectrum of the time domain wave form of FIG. 5*c;*

Thus, a noise-like portion of the audio signal does not show neither any impulse-like time-domain structure nor harmonic frequency-domain structure as illustrated in FIG. 5*c* and in FIG. 5*d*, which is different from the quasi-periodic impulse-like portion as illustrated for example in FIG. 5*a* and in FIG. 5*b*. As will be outlined later on, however, the differentiation between noise-like portions and quasi-periodic impulse-like portions can also be observed after a LPC for the excitation signal. The LPC is a method which models the vocal tract and extracts from the signal the excitation of the vocal tracts.

Furthermore, quasi-periodic impulse-like portions and noise-like portions can occur in a timely manner, i.e., which means that a portion of the audio signal in time is noisy and another portion of the audio signal in time is quasi-periodic, i.e. tonal. Alternatively, or additionally, the characteristic of a signal can be different in different frequency bands. Thus, the determination, whether the audio signal is noisy or tonal, can also be performed frequency-selective so that a certain frequency band or several certain frequency bands are considered to be noisy and other frequency bands are considered to be tonal. In this case, a certain time portion of the audio signal might include tonal components and noisy components.

FIG. 7*a* illustrates a linear model of a speech production system. This system assumes a two-stage excitation, i.e., an impulse-train for voiced speech as indicated in FIG. 7*c*, and a random-noise for unvoiced speech as indicated in FIG. 7*d*. The vocal tract is modelled as an all-pole filter 70 which processes pulses of FIG. 7*c* or FIG. 7*d*, generated by the glottal model 72. Hence, the system of FIG. 7*a* can be reduced to an all pole-filter model of FIG. 7*b* having a gain stage 77, a forward path 78, a feedback path 79, and an adding stage 80. In the feedback path 79, there is a prediction filter 81, and the whole source-model synthesis system illustrated in FIG. 7*b* can be represented using z-domain functions as follows:

$$S(z)=g/(1-A(z))\cdot X(z),$$

where g represents the gain, A(z) is the prediction filter as determined by an LP analysis, X(z) is the excitation signal, and S(z) is the synthesis speech output.

FIGS. 7*c* and 7*d* give a graphical time domain description of voiced and unvoiced speech synthesis using the linear source system model. This system and the excitation parameters in the above equation are unknown and may be determined from a finite set of speech samples. The coefficients of A(z) are obtained using a linear prediction of the input signal and a quantization of the filter coefficients. In a p-th order forward linear predictor, the present sample of the speech sequence is predicted from a linear combination of p passed samples. The predictor coefficients can be determined by well-known algorithms such as the Levinson-Durbin algorithm, or generally an autocorrelation method or a reflection method.

FIG. 7*e* illustrates a more detailed implementation of the LPC analysis block 510. The audio signal is input into a filter determination block which determines the filter information A(z). This information is output as the short-term prediction information that may be used for a decoder. This information is quantized by a quantizer 81 as known, for example from the AMR-WB+ specification. The short-term prediction information may be used by the actual prediction filter 85. In a subtracter 86, a current sample of the audio signal is input and a predicted value for the current sample is subtracted so that for this sample, the prediction error signal is generated at line 84. A sequence of such prediction error signal samples is very schematically illustrated in FIG. 7*c* or 7*d*. Therefore, FIG. 7*c*, 7*d* can be considered as a kind of a rectified impulse-like signal.

While FIG. 7*e* illustrates an advantageous way to calculate the excitation signal, FIG. 7*f* illustrates an advantageous way to calculate the weighted signal. In contrast to FIG. 7*e*, the filter 85 is different, when γ is different from 1. A value smaller than 1 is advantageous for γ. Furthermore, the block 87 is present, and μ is advantageously a number smaller than 1. Generally, the elements in FIGS. 7*e* and 7*f* can be implemented as in 3GPP TS 26.190 or 3GPP TS 26.290.

Figure 7G:
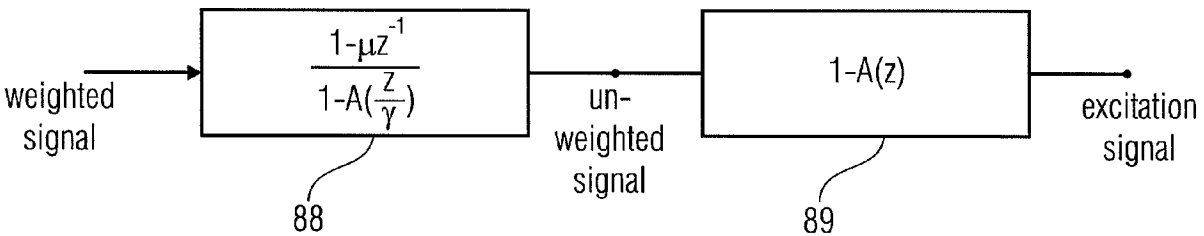
FIG. 7*g* illustrates an implementation for transforming a weighted signal into an excitation signal by applying an inverse weighting operation and a subsequent excitation analysis as may be useful in the converter 537 of FIG. 2*b;*

FIG. 7*g* illustrates an inverse processing, which can be applied on the decoder side such as in element 537 of FIG. 2*b*. Particularly, block 88 generates an unweighted signal from the weighted signal and block 89 calculates an excitation from the unweighted signal. Generally, all signals but the unweighted signal in FIG. 7*g* are in the LPC domain, but the excitation signal and the weighted signal are different signals in the same domain. Block 89 outputs an excitation signal which can then be used together with the output of block 536. Then, the common inverse LPC transform can be performed in block 540 of FIG. 2*b*.

Figure 6:
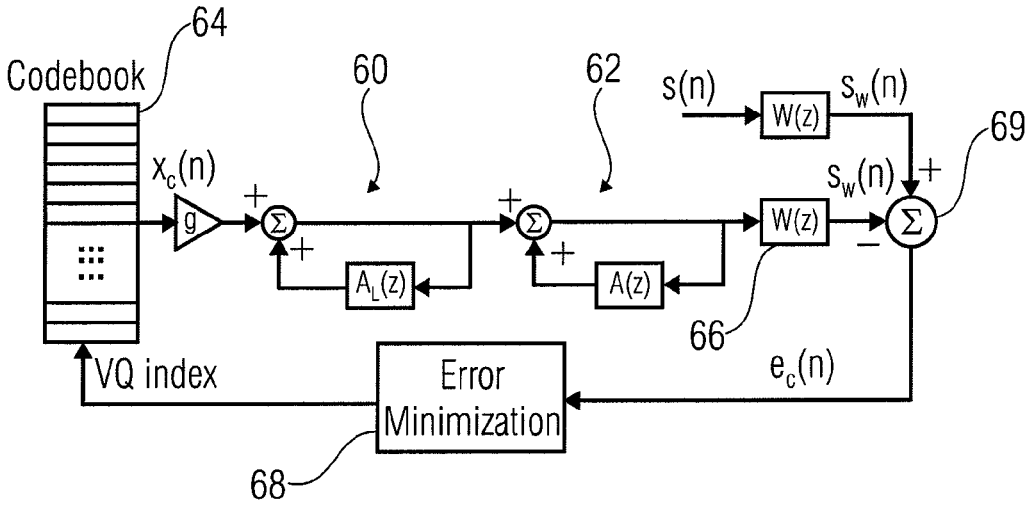
FIG. 6 illustrates a block diagram of an analysis by synthesis CELP encoder.

Subsequently, an analysis-by-synthesis CELP encoder will be discussed in connection with FIG. 6 in order to illustrate the modifications applied to this algorithm. This CELP encoder is discussed in detail in "Speech Coding: A Tutorial Review", Andreas Spanias, Proceedings of the IEEE, Vol. 82, No. 10, October 1994, pages 1541-1582. The CELP encoder as illustrated in FIG. 6 includes a long-term prediction component 60 and a short-term prediction component 62. Furthermore, a codebook is used which is indicated at 64. A perceptual weighting filter W(z) is implemented at 66, and an error minimization controller is provided at 68. s(n) is the time-domain input signal. After having been perceptually weighted, the weighted signal is input into a subtracter 69, which calculates the error between the weighted synthesis signal at the output of block 66 and the original weighted signal $s_w(n)$. Generally, the short-term prediction filter coefficients A(z) are calculated by an LP analysis stage and its coefficients are quantized in $\hat{A}(z)$ as indicated in FIG. 7*e*. The long-term prediction information $A_L(z)$ including the long-term prediction gain g and the vector quantization index, i.e., codebook references are calculated on the prediction error signal at the output of the LPC analysis stage referred as 10*a* in FIG. 7*e*. The LTP parameters are the pitch delay and gain. In CELP this is usually implemented as an adaptive codebook containing the past excitation signal (not the residual). The adaptive CB delay and gain are found by minimizing the mean-squared weighted error (closed-loop pitch search).

The CELP algorithm encodes then the residual signal obtained after the short-term and long-term predictions using a codebook of for example Gaussian sequences. The ACELP algorithm, where the "A" stands for "Algebraic" has a specific algebraically designed codebook.

A codebook may contain more or less vectors where each vector is some samples long. A gain factor g scales the code vector and the gained code is filtered by the long-term prediction synthesis filter and the short-term prediction synthesis filter. The "optimum" code vector is selected such that the perceptually weighted mean square error at the output of the subtracter 69 is minimized. The search process in CELP is done by an analysis-by-synthesis optimization as illustrated in FIG. 6.

For specific cases, when a frame is a mixture of unvoiced and voiced speech or when speech over music occurs, a TCX coding can be more appropriate to code the excitation in the LPC domain. The TCX coding processes the a weighted signal in the frequency domain without doing any assumption of excitation production. The TCX is then more generic than CELP coding and is not restricted to a voiced or a non-voiced source model of the excitation. TCX is still a source-filer model coding using a linear predictive filter for modelling the formants of the speech-like signals.

In the AMR-WB+-like coding, a selection between different TCX modes and ACELP takes place as known from the AMR-WB+ description. The TCX modes are different in that the length of the block-wise Discrete Fourier Transform is different for different modes and the best mode can be selected by an analysis by synthesis approach or by a direct "feedforward" mode.

As discussed in connection with FIGS. 2*c* and 2*d*, the common pre-processing stage 100 advantageously includes a joint multi-channel (surround/joint stereo device) 101 and, additionally, a band width extension stage 102. Correspondingly, the decoder includes a band width extension stage 701 and a subsequently connected joint multichannel stage 702. Advantageously, the joint multichannel stage 101 is, with respect to the encoder, connected before the band width extension stage 102, and, on the decoder side, the band width extension stage 701 is connected before the joint multichannel stage 702 with respect to the signal processing direction. Alternatively, however, the common pre-processing stage can include a joint multichannel stage without the subsequently connected bandwidth extension stage or a bandwidth extension stage without a connected joint multichannel stage.

Figure 8:
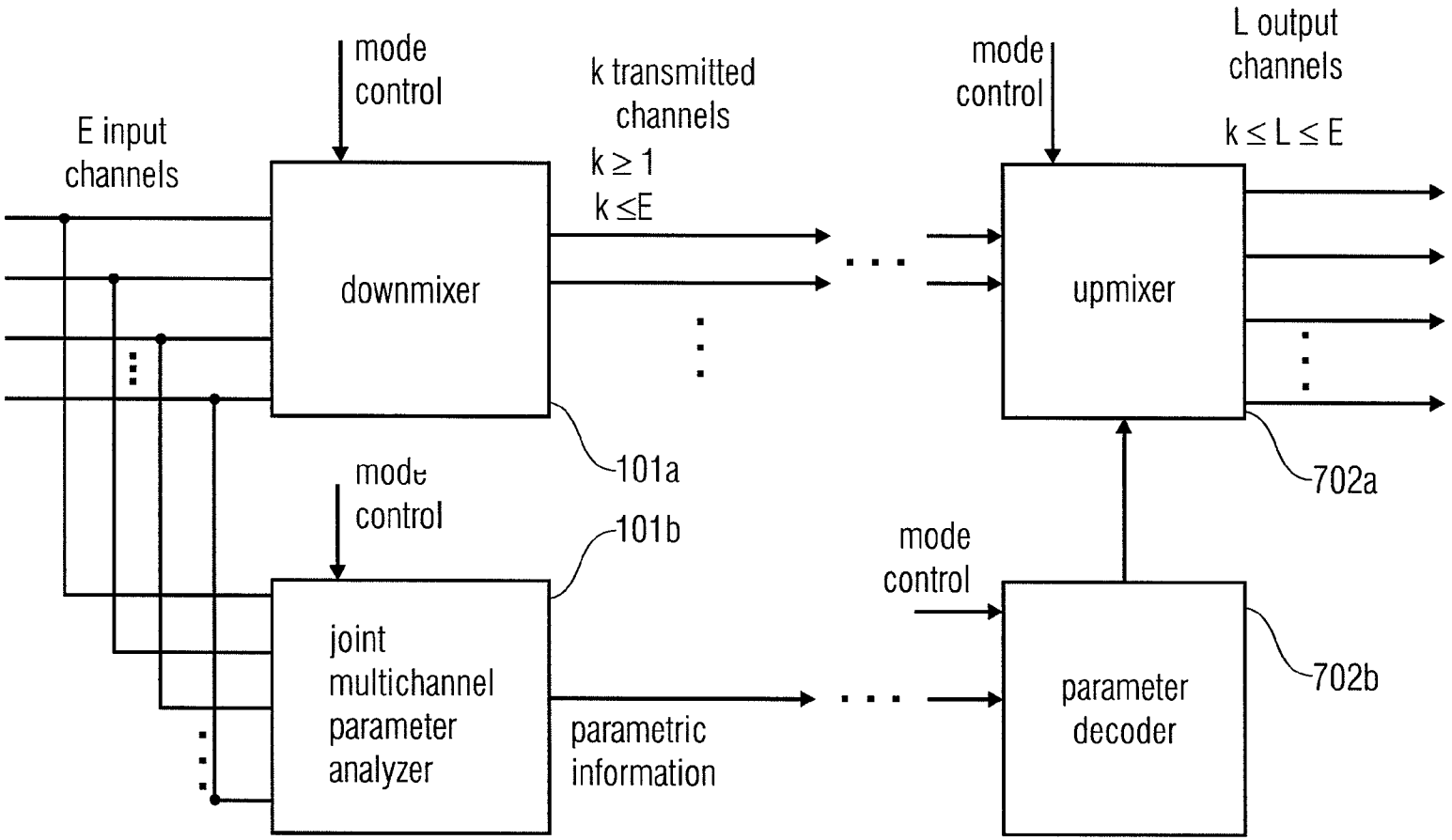
FIG. 8 illustrates a block diagram of a joint multi-channel algorithm in accordance with an embodiment of the present invention.

An advantageous example for a joint multichannel stage on the encoder side 101*a*, 101*b* and on the decoder side 702*a* and 702*b* is illustrated in the context of FIG. 8. A number of E original input channels is input into the downmixer 101*a* so that the downmixer generates a number of K transmitted channels, where the number K is greater than or equal to one and is smaller than or equal E.

Advantageously, the E input channels are input into a joint multichannel parameter analyser 101*b* which generates parametric information. This parametric information is advantageously entropy-encoded such as by a different encoding and subsequent Huffman encoding or, alternatively, subsequent arithmetic encoding. The encoded parametric information output by block 101*d* is transmitted to a parameter decoder 702*b* which may be part of item 702 in FIG. 2*b*. The parameter decoder 702*b* decodes the transmitted parametric information and forwards the decoded parametric information into the upmixer 702*a*. The upmixer 702*a* receives the K transmitted channels and generates a number of L output channels, where the number of L is greater than or equal K and lower than or equal to E.

Parametric information may include inter channel level differences, inter channel time differences, inter channel phase differences and/or inter channel coherence measures as is known from the BCC technique or as is known and is described in detail in the MPEG surround standard. The number of transmitted channels may be a single mono channel for ultra-low bit rate applications or may include a compatible stereo application or may include a compatible stereo signal, i.e., two channels. Typically, the number of E input channels may be five or maybe even higher. Alternatively, the number of E input channels may also be E audio objects as it is known in the context of spatial audio object coding (SAOC).

In one implementation, the downmixer performs a weighted or unweighted addition of the original E input channels or an addition of the E input audio objects. In case of audio objects as input channels, the joint multichannel parameter analyser 101*b* will calculate audio object parameters such as a correlation matrix between the audio objects advantageously for each time portion and even more advantageously for each frequency band. To this end, the whole frequency range may be divided in at least 10 and advantageously 32 or 64 frequency bands.

Figure 9:
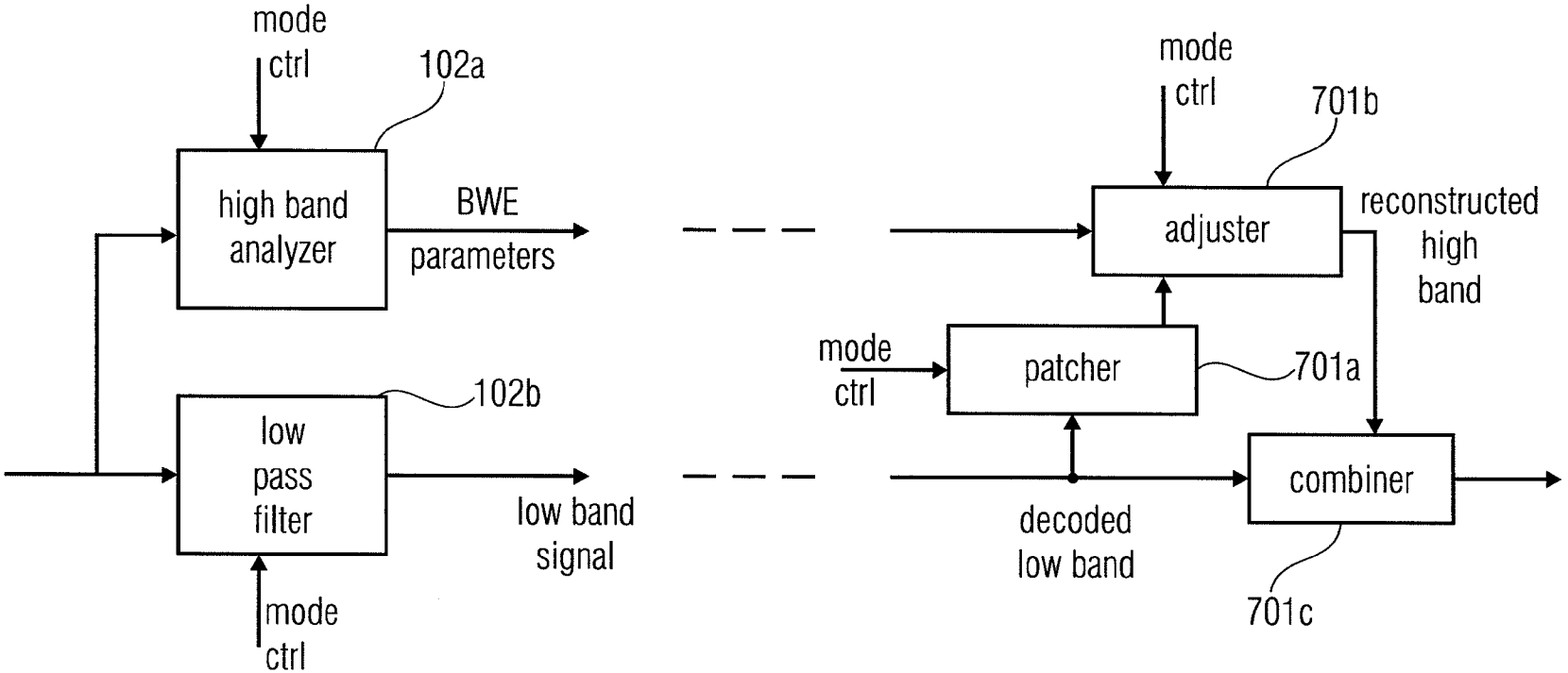
FIG. 9 illustrates an advantageous embodiment of a bandwidth extension algorithm.

FIG. 9 illustrates an advantageous embodiment for the implementation of the bandwidth extension stage 102 in FIG. 2*a* and the corresponding band width extension stage 701 in FIG. 2*b*. On the encoder-side, the bandwidth extension block 102 advantageously includes a low pass filtering block 102*b*, a downsampler block, which follows the lowpass, or which is part of the inverse QMF, which acts on only half of the QMF bands, and a high band analyser 102*a*. The original audio signal input into the bandwidth extension block 102 is lowpass filtered to generate the low band signal which is then input into the encoding branches and/or the switch. The low pass filter has a cut off frequency which can be in a range of 3 kHz to 10 kHz. Furthermore, the bandwidth extension block 102 furthermore includes a high band analyser for calculating the bandwidth extension parameters such as a spectral envelope parameter information, a noise floor parameter information, an inverse filtering parameter information, further parametric information relating to certain harmonic lines in the high band and additional parameters as discussed in detail in the MPEG-4 standard in the chapter related to spectral band replication.

On the decoder-side, the bandwidth extension block 701 includes a patcher 701*a*, an adjuster 701*b* and a combiner 701*c*. The combiner 701*c* combines the decoded low band signal and the reconstructed and adjusted high band signal output by the adjuster 701*b*. The input into the adjuster 701*b* is provided by a patcher which is operated to derive the high band signal from the low band signal such as by spectral band replication or, generally, by bandwidth extension. The patching performed by the patcher 701*a* may be a patching performed in a harmonic way or in a non-harmonic way. The signal generated by the patcher 701*a* is, subsequently, adjusted by the adjuster 701*b* using the transmitted parametric bandwidth extension information.

As indicated in FIG. 8 and FIG. 9, the described blocks may have a mode control input in an advantageous embodiment. This mode control input is derived from the decision stage 300 output signal. In such an advantageous embodiment, a characteristic of a corresponding block may be adapted to the decision stage output, i.e., whether, in an advantageous embodiment, a decision to speech or a decision to music is made for a certain time portion of the audio signal. Advantageously, the mode control only relates to one or more of the functionalities of these blocks but not to all of the functionalities of blocks. For example, the decision may influence only the patcher 701*a* but may not influence the other blocks in FIG. 9, or may, for example, influence only the joint multichannel parameter analyser 101*b* in FIG. 8 but not the other blocks in FIG. 8. This implementation is advantageously such that a higher flexibility and higher quality and lower bit rate output signal is obtained by providing flexibility in the common pre-processing stage. On the other hand, however, the usage of algorithms in the common pre-processing stage for both kinds of signals allows to implement an efficient encoding/decoding scheme.

Figure 10A:
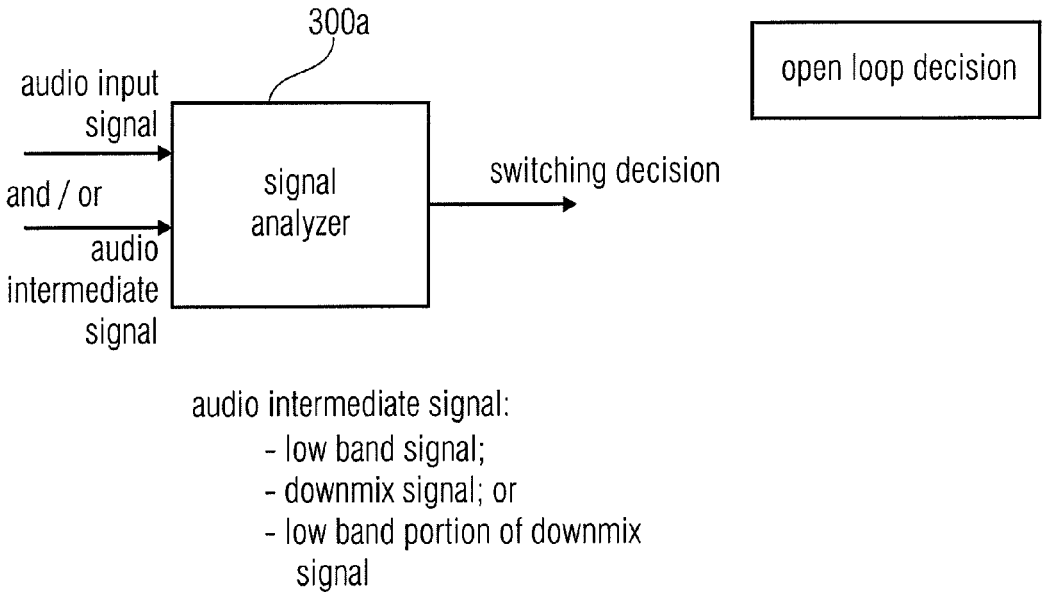
FIG. 10*a* illustrates a detailed description of the switch when performing an open loop decision.
Figure 10B:
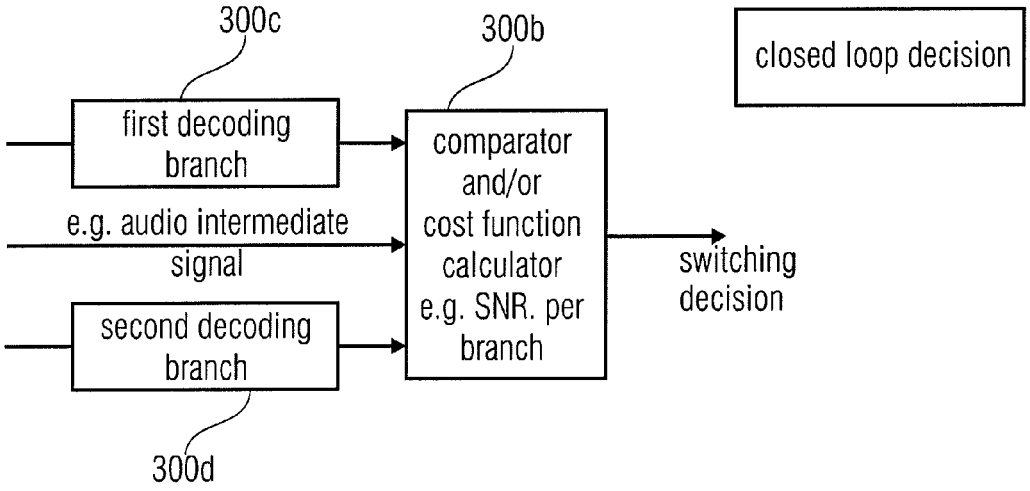
FIG. 10*b* illustrates an illustration of the switch when operating in a closed loop decision mode.

FIG. 10*a* and FIG. 10*b* illustrates two different implementations of the decision stage 300. In FIG. 10*a*, an open loop decision is indicated. Here, the signal analyser 300*a* in the decision stage has certain rules in order to decide whether the certain time portion or a certain frequency portion of the input signal has a characteristic which entails that this signal portion is encoded by the first encoding branch 400 or by the second encoding branch 500. To this end, the signal analyser 300*a* may analyse the audio input signal into the common pre-processing stage or may analyse the audio signal output by the common pre-processing stage, i.e., the audio intermediate signal or may analyse an intermediate signal within the common pre-processing stage such as the output of the downmix signal which may be a mono signal or which may be a signal having k channels indicated in FIG. 8. On the output-side, the signal analyser 300*a* generates the switching decision for controlling the switch 200 on the encoder-side and the corresponding switch 600 or the combiner 600 on the decoder-side.

Alternatively, the decision stage 300 may perform a closed loop decision, which means that both encoding branches perform their tasks on the same portion of the audio signal and both encoded signals are decoded by corresponding decoding branches 300*c*, 300*d*. The output of the devices 300*c* and 300*d* is input into a comparator 300*b* which compares the output of the decoding devices to put the corresponding portion of the, for example, audio intermediate signal. Then, dependent on a cost function such as a signal to noise ratio per branch, a switching decision is made. This closed loop decision has an increased complexity compared to the open loop decision, but this complexity is only existing on the encoder-side, and a decoder does not have any disadvantage from this process, since the decoder can advantageously use the output of this encoding decision. Therefore, the closed loop mode is advantageous due to complexity and quality considerations in applications, in which the complexity of the decoder is not an issue such as in broadcasting applications where there is only a small number of encoders but a large number of decoders which, in addition, have to be smart and cheap.

The cost function applied by the comparator 300*d* may be a cost function driven by quality aspects or may be a cost function driven by noise aspects or may be a cost function driven by bit rate aspects or may be a combined cost function driven by any combination of bit rate, quality, noise (introduced by coding artefacts, specifically, by quantization), etc.

Advantageously, the first encoding branch or the second encoding branch includes a time warping functionality in the encoder side and correspondingly in the decoder side. In one embodiment, the first encoding branch comprises a time warper module for calculating a variable warping characteristic dependent on a portion of the audio signal, a resampler for re-sampling in accordance with the determined warping characteristic, a time domain/frequency domain converter, and an entropy coder for converting a result of the time domain/frequency domain conversion into an encoded representation. The variable warping characteristic is included in the encoded audio signal. This information is read by a time warp enhanced decoding branch and processed to finally have an output signal in a non-warped time scale. For example, the decoding branch performs entropy decoding, dequantization and a conversion from the frequency domain back into the time domain. In the time domain, the dewarping can be applied and may be followed by a corresponding resampling operation to finally obtain a discrete audio signal with a non-warped time scale.

Depending on certain implementation requirements of the inventive methods, the inventive methods can be implemented in hardware or in software. The implementation can be performed using a digital storage medium, in particular, a disc, a DVD or a CD having electronically-readable control signals stored thereon, which co-operate with programmable computer systems such that the inventive methods are performed. Generally, the present invention is therefore a computer program product with a program code stored on a machine-readable carrier, the program code being operated for performing the inventive methods when the computer program product runs on a computer. In other words, the inventive methods are, therefore, a computer program having a program code for performing at least one of the inventive methods when the computer program runs on a computer.

The inventive encoded audio signal can be stored on a digital storage medium or can be transmitted on a transmission medium such as a wireless transmission medium or a wired transmission medium such as the Internet.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. An apparatus for encoding an audio signal to acquire an encoded audio signal, the audio signal being in a first domain, comprising:

a first domain converter for converting the audio signal from the first domain into a second domain;

a switchable bypass for bypassing the first domain converter or for causing a conversion of the audio signal by the first domain converter in response to a bypass switch control signal;

a second domain converter for converting an audio signal received from the switchable bypass or the first domain converter into a third domain, the third domain being different from the second domain;

a first processor for encoding the third domain audio signal in accordance with a first coding algorithm to acquire a first processed signal; and a second processor for encoding the audio signal received from the first domain converter in accordance with a second coding algorithm being different from the first coding algorithm to acquire a second processed signal, wherein the encoded signal for a portion of the audio signal either comprises the first processed signal or the second processed signal.

2. The apparatus in accordance with claim 1 in which the first domain converter comprises an LPC analysis filter for LPC filtering the audio signal to acquire an LPC residual signal and LPC parameter data.

3. The apparatus in accordance with claim 1 in which the second domain converter comprises a time-frequency converter for converting an input signal into a spectral representation thereof.

4. The apparatus in accordance with claim 1 in which the second processor is operative to generate an encoded output signal so that the encoded output signal is in the same domain as an input signal into the second processor.

5. The apparatus in accordance with claim 1 in which the first processor comprises a quantizer and an entropy encoder and in which the second processor comprises a code book-based source encoder.

6. The apparatus in accordance with claim 1 in which the first processor is based on an information sink model and the second processor is based on an information source model.

7. The apparatus in accordance with claim 1 further comprising a switching stage connected between an output of the first domain converter and an input of the second domain converter and an input of the second processor, wherein the switching stage is adapted to switch between the input of the second domain converter and the input of the second processor in response to a switching stage control signal.

8. The apparatus in accordance with claim 1 in which an output of the switchable bypass is connected to an output of the first domain converter and an input of the switchable bypass is connected to an input into the first domain converter.

9. The apparatus in accordance with claim 1, further comprising a signal classifier for controlling the switchable bypass for a portion of the audio signal depending on an analysis result for the portion of the audio signal.

10. The apparatus in accordance with claim 1 in which the second domain converter is operative to convert an input signal in a block-based way and in which the second domain converter is operative to perform a block-based switching in response to an audio signal analysis so that the second domain converter is controlled in that blocks of different lengths are converted depending on the content of the audio signal.

11. A method of encoding an audio signal to acquire an encoded audio signal, the audio signal being in a first domain, comprising:

converting the audio signal from the first domain into a second domain;

bypassing converting the audio signal from the first domain into a second domain or causing a conversion of the audio signal from the first domain into a second domain in response to a bypass switch control signal;

converting a bypassed audio signal or an audio signal in the second domain into a third domain, the third domain being different from the second domain;

encoding the third domain audio signal generated by converting the bypassed audio signal or the audio signal in the second domain in accordance with a first coding algorithm to acquire a first processed signal; and encoding the audio signal in the second domain in accordance with a second coding algorithm being different from the first coding algorithm to acquire a second processed signal, wherein the encoded signal for a portion of the audio signal either comprises the first processed signal or the second processed signal.

12. An apparatus for decoding an encoded audio signal, the encoded audio signal comprising a first processed signal being in a third domain and a second processed signal being in a second domain, wherein the second domain and the third domain are different from each other, comprising:

a first inverse processor for inverse processing the first processed signal;

a second inverse processor for inverse processing the second processed signal;

a second converter for domain converting the first inverse processed signal from the third domain into a different domain;

a first converter for converting the second inverse processed signal into a first domain or for converting the first inverse processed signal, which was converted into a different domain, into the first domain when the different domain is not the first domain; and a bypass for bypassing the first converter when the different domain is the first domain.

13. The apparatus in accordance with claim 12, further comprising a combiner for combining an output of the first converter and an output of the bypass to acquire a combined decoded audio signal.

14. The apparatus for decoding in accordance with claim 12, further comprising an input interface for extracting, from an encoded audio signal, the first processed signal, the second processed signal and the control signal indicating whether for a certain first inverse processed signal, the first converter is to be bypassed by the bypass or not.

15. The apparatus for decoding in accordance with claim 12 in which the first converter comprises a linear prediction coding (LPC) synthesis stage, and wherein the second converter comprises a spectral-time converter for converting a spectral representation of an audio signal into a time representation of the audio signal.

16. The apparatus for decoding in accordance with claim 12 in which the first inverse processor comprises an entropy-decoder and a de-quantizer and in which the second inverse processor comprises the code book-based source decoder.

17. The apparatus for decoding in accordance with claim 12 in which the second converter is operative to perform a synthesis filtering operation such as an inverse time warped modified discrete cosine transform filtering operation controllable by additional information comprised by the encoded audio signal.

18. A method of decoding an encoded audio signal, the encoded audio signal comprising a first processed signal being in a third domain and a second processed signal being in a second domain, wherein the second domain and the third domain are different from each other, comprising:

inverse processing the first processed signal;

inverse processing the second processed signal;

second domain converting the first inverse processed signal from the third domain into a different domain;

first domain converting the second inverse processed signal into a first domain or converting the first inverse processed signal into the first domain when the different domain is not the first domain; and bypassing first domain converting when the different domain is the first domain.

19. A non-transitory computer readable medium having stored thereon a computer program for performing, when running on a computer, a method of encoding an audio signal to acquire an encoded audio signal, the audio signal being in a first domain, comprising:

converting the audio signal from the first domain into a second domain;

bypassing converting the audio signal from the first domain into a second domain or causing a conversion of the audio signal from the first domain into a second domain in response to a bypass switch control signal;

converting a bypassed audio signal or an audio signal in the second domain into a third domain, the third domain being different from the second domain;

encoding the third domain audio signal generated by converting the bypassed audio signal or the audio signal in the second domain in accordance with a first coding algorithm to acquire a first processed signal; and encoding the audio signal in the second domain in accordance with a second coding algorithm being different from the first coding algorithm to acquire a second processed signal, wherein the encoded signal for a portion of the audio signal either comprises the first processed signal or the second processed signal.

20. A non-transitory computer readable medium having stored thereon a computer program for performing, when running on a computer, a method of decoding an encoded audio signal, the encoded audio signal comprising a first processed signal being in a third domain and a second processed signal being in a second domain, wherein the second domain and the third domain are different from each other, comprising:

inverse processing the first processed signal;

inverse processing the second processed signal;

second domain converting the first inverse processed signal from the third domain into a different domain;

first domain converting the second inverse processed signal into a first domain or converting the first inverse processed signal into the first domain when the different domain is not the first domain; and bypassing first domain converting when the different domain is the first domain.

* * * * *